US011105579B2

(12) United States Patent
Summers et al.

(10) Patent No.: US 11,105,579 B2
(45) **Date of Patent: *Aug. 31, 2021**

(54) ARROW REST ASSEMBLY

(71) Applicant: QTM, LLC, Madison Heights, VA (US)

(72) Inventors: Daniel A. Summers, Alpine, WY (US); Kevin S. Fry, Madison Heights, VA (US); Jonathan M. Loomis, Lynchburg, VA (US)

(73) Assignee: QTM, LLC, Madison Heights, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/696,083

(22) Filed: Nov. 26, 2019

(65) Prior Publication Data

US 2020/0096286 A1 Mar. 26, 2020

Related U.S. Application Data

(63) Continuation of application No. 15/863,416, filed on Jan. 5, 2018, now Pat. No. 10,514,228.

(60) Provisional application No. 62/442,747, filed on Jan. 5, 2017.

(51) Int. Cl.

| | |
|---|---|
| ***F41B 5/22*** | (2006.01) |
| ***F41B 5/14*** | (2006.01) |
| *F41G 1/467* | (2006.01) |

(52) U.S. Cl.

CPC ..... *F41B 5/1403* (2013.01); *F41B 5/143* (2013.01); *F41B 5/1434* (2013.01); *F41B 5/1438* (2013.01); *F41G 1/467* (2013.01)

(58) Field of Classification Search

CPC ..... F41B 5/143; F41B 5/1403; F41B 5/1434; F41B 5/1438; F41G 1/467

USPC ..... 124/44.5, 86, 87; 33/265

See application file for complete search history.

(56) References Cited

U.S. PATENT DOCUMENTS

| | | | | | |
|---|---|---|---|---|---|
| 4,324,221 | A * | 4/1982 | Peck | F41B 5/143 | 124/24.1 |
| 4,686,956 | A * | 8/1987 | Troncoso, Jr. | F41B 5/1438 | 124/44.5 |
| 4,809,670 | A * | 3/1989 | Simo | F41B 5/143 | 124/24.1 |
| 5,062,407 | A * | 11/1991 | Newbold | F41B 5/143 | 124/44.5 |
| 5,070,855 | A * | 12/1991 | Troncoso | F41B 5/143 | 124/44.5 |

(Continued)

OTHER PUBLICATIONS

"Ripcord X-Factor"; Ripcord Arrow Rest; Sep. 23, 2015; retrieved from the Internet: <http://ripcordarrowrest.com/ripcord-xfactor>; 2 pages.

*Primary Examiner* — Alexander R Niconovich
(74) *Attorney, Agent, or Firm* — Barclay Damon LLP

(57) ABSTRACT

An arrow rest assembly and method are described herein. The arrow rest assembly, in an embodiment, includes a bow engagement portion configured to be mounted to an archery bow and an accessory support coupled to the bow engagement portion. The accessory support is configured to support an arrow rest accessory that has an arrow holder. The assembly includes an adjuster support, a driver engaged with the adjuster support, and a biaser coupled to the driver. The biaser is configured to generate a biasing force acting on the driver.

22 Claims, 43 Drawing Sheets

(56) References Cited

U.S. PATENT DOCUMENTS 5,103,797 A * 4/1992 Newbold ..... F41B 5/143 124/24.1
5,251,606 A * 10/1993 Colvin ..... F41B 5/1438 124/44.5
5,467,759 A * 11/1995 Troncoso ..... F41B 5/143 124/24.1
5,476,086 A * 12/1995 Smith ..... F41B 5/143 124/24.1
5,522,375 A * 6/1996 Simo ..... F41B 5/143 124/86
5,526,799 A * 6/1996 Simo ..... F41B 5/1438 124/44.5
5,711,803 A 1/1998 Pehnt et al.
6,021,769 A * 2/2000 Troncoso ..... F41B 5/143 124/44.5
6,050,251 A * 4/2000 Harwath ..... F41B 5/143 124/44.5
6,178,959 B1 * 1/2001 Troncoso, Jr. ..... F41B 5/143 124/44.5
6,505,619 B2 1/2003 Hulm
6,520,170 B1 * 2/2003 Adkins ..... F41B 5/14 124/44.5
6,561,174 B1 5/2003 Afshari
6,595,195 B1 7/2003 Barner et al.
6,634,349 B2 * 10/2003 Mizek ..... F41B 5/143 124/44.5
6,688,297 B1 2/2004 Clague
6,739,321 B1 5/2004 Puchlerz
6,772,747 B1 8/2004 Vastag
6,789,536 B1 9/2004 Summers
6,938,616 B2 * 9/2005 Walk ..... F41B 5/143 124/44.5
7,219,662 B1 * 5/2007 Henry ..... F41B 5/143 124/44.5
7,278,216 B2 10/2007 Grace
7,331,338 B2 2/2008 Mizek
7,360,313 B1 4/2008 Hamm et al.
7,409,950 B2 * 8/2008 Ellig ..... F41B 5/143 124/44.5
7,681,566 B2 3/2010 Mertens
7,900,365 B1 * 3/2011 Johnson ..... F41G 1/467 33/265
8,240,075 B1 8/2012 Mullin
8,434,464 B1 5/2013 Terzo
8,474,443 B2 7/2013 Geno
8,544,457 B1 10/2013 Munsell et al.
8,701,643 B2 4/2014 Ellig
8,839,772 B2 9/2014 Lee
8,939,137 B2 1/2015 Hunt
8,967,131 B2 3/2015 Hunt
8,973,277 B2 * 3/2015 Pulkrabek ..... F41G 1/467 33/265
9,151,567 B1 * 10/2015 Estridge ..... F41B 5/143
9,341,433 B1 * 5/2016 Summers ..... F41B 5/143
9,581,406 B1 2/2017 Nevels et al.
9,726,453 B1 8/2017 Hamm et al.
9,816,776 B2 * 11/2017 Ellig ..... F41B 5/143
9,869,528 B2 * 1/2018 Pellett ..... F41G 1/467
9,933,229 B2 4/2018 Coalson et al.
10,190,851 B1 * 1/2019 Hamm ..... F41G 1/467
2002/0096161 A1 7/2002 Hulm
2003/0024516 A1 2/2003 Mizek et al.
2003/0029429 A1 2/2003 Adkins
2003/0056379 A1 * 3/2003 Johnson ..... F41G 1/467 33/265
2003/0136393 A1 7/2003 Barner et al.
2005/0076895 A1 4/2005 Walk
2006/0157038 A1 7/2006 Ellig et al.
2006/0162709 A1 * 7/2006 Roberts ..... F41B 5/143 124/44.5
2007/0119439 A1 5/2007 Mizek
2007/0163560 A1 * 7/2007 Mertens ..... F41B 5/143 124/44.5
2011/0139138 A1 6/2011 Geno
2012/0138035 A1 6/2012 Ellig
2013/0081604 A1 4/2013 Lee
2013/0269668 A1 10/2013 Hunt
2014/0014082 A1 1/2014 Hunt
2015/0184972 A1 * 7/2015 Grace ..... F41B 5/143 124/44.5
2016/0025456 A1 * 1/2016 Hamm ..... F41G 1/41 33/265
2017/0003096 A1 1/2017 Ellig et al.
2017/0191788 A1 7/2017 Eacker
2018/0045488 A1 * 2/2018 Hamm ..... F41G 1/38
2018/0058798 A1 * 3/2018 Coalson ..... F41B 5/143

* cited by examiner

ARROW REST ASSEMBLY

CROSS-REFERENCE TO RELATED APPLICATION

This application is a continuation application of, and claims the benefit and priority of, U.S. patent application Ser. No. 15/863,416, filed on Jan. 5, 2018, which is a non-provisional of, and claims the benefit and priority of, U.S. Provisional Patent Application No. 62/442,747 filed on Jan. 5, 2017. The entire contents of such applications are hereby incorporated by reference.

BACKGROUND

A variety of different ways have been used to attach accessories, such as arrow rests, sight devices and cable guards, to archery bows. One known way is to use a preexisting hole through the side of the bow. An accessory, such as the conventional arrow rest, has a main part screwed to a separate bracket. The user can insert a screw through the bow's hole to attach the arrow rest's bracket to the side of the bow. Another known way is to adhesively attach a self-adhesive arrow rest to the side of the bow. These known ways have several disadvantages. With both attachment methods, it is difficult to adjust the position of the arrow rest after it's installed. For that reason, adjustable mounts have been developed to allow a user to adjust the position of the arrow rest.

However, such adjustable mounts suffer from several disadvantages. For example, such mounts can have large of gaps between positions, making it difficult to make a precision adjustment. Also, with such mounts, it can be difficult for the user to start and stop the adjustment process at discrete positions corresponding to measurement markings. In addition, such mounts can be inadvertently moved out of the desired position due to bumping, shooting vibrations or other forces or touching. Furthermore, when turning a typical adjustment knob, an initial turn of the knob does not immediately move the accessory due to "slop" or lag in the adjustable mount. This "slop" can also make precision adjustments difficult, as well as making it difficult to return to a desired position.

The foregoing background describes some, but not necessarily all, of the problems, disadvantages and shortcomings related to the mounting of accessories to archery bows.

DETAILED DESCRIPTION

Figure 1:
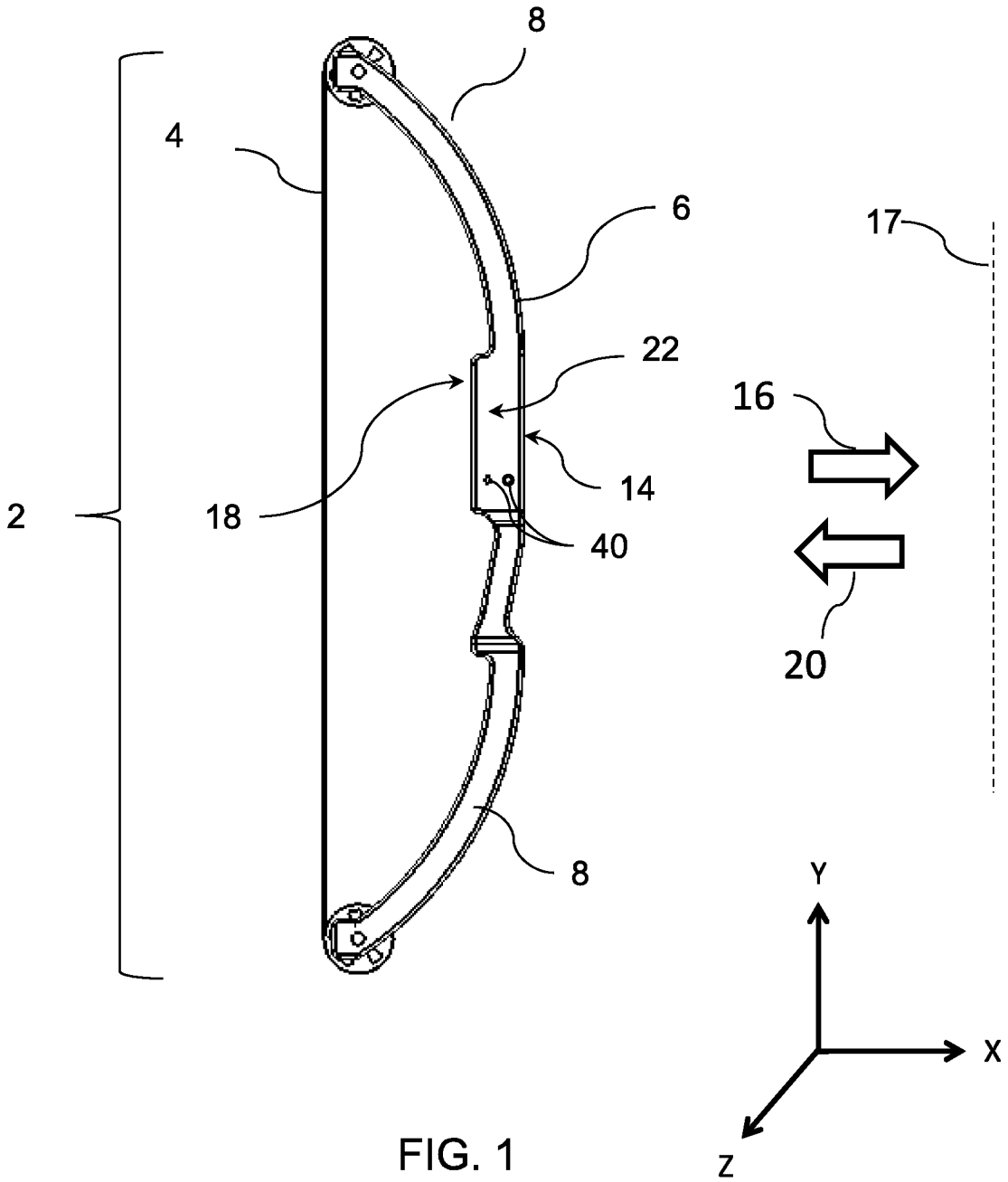
FIG. 1 is a side view of an embodiment of an archery bow.
Figure 2:
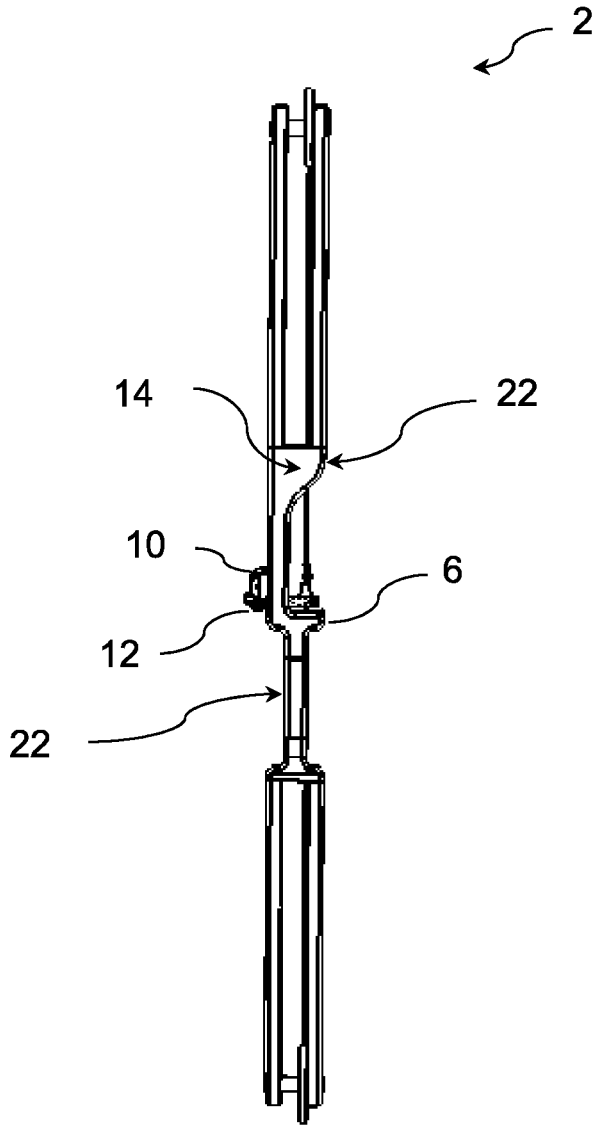
FIG. 2 is a front view of the archery bow of FIG. 1.
Figure 3:
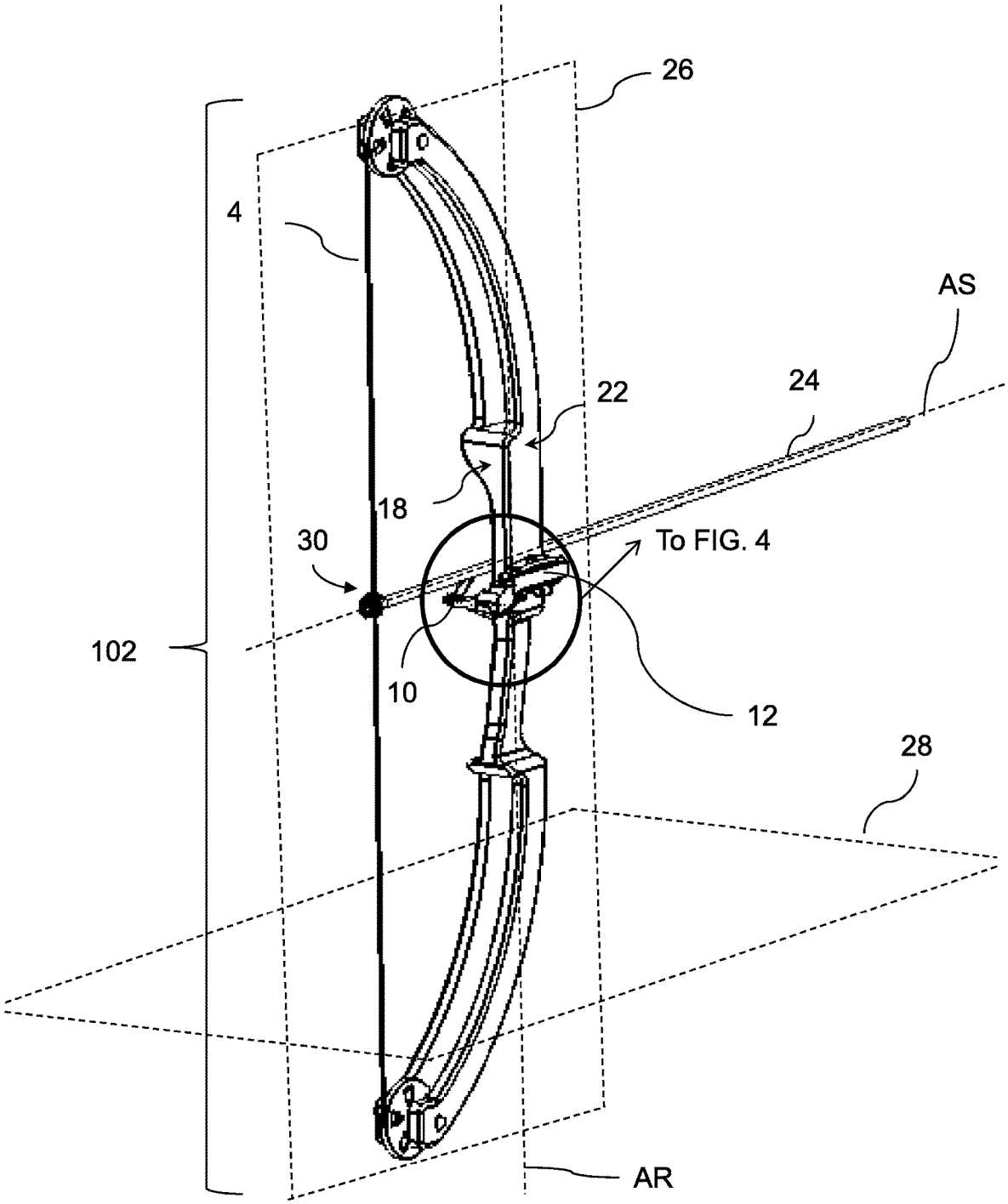
FIG. 3 is a rear isometric view of an embodiment of an archery bow with an arrow, undrawn, illustrating an embodiment of a bow accessory mounting system coupled to the archery bow.
Figure 4:
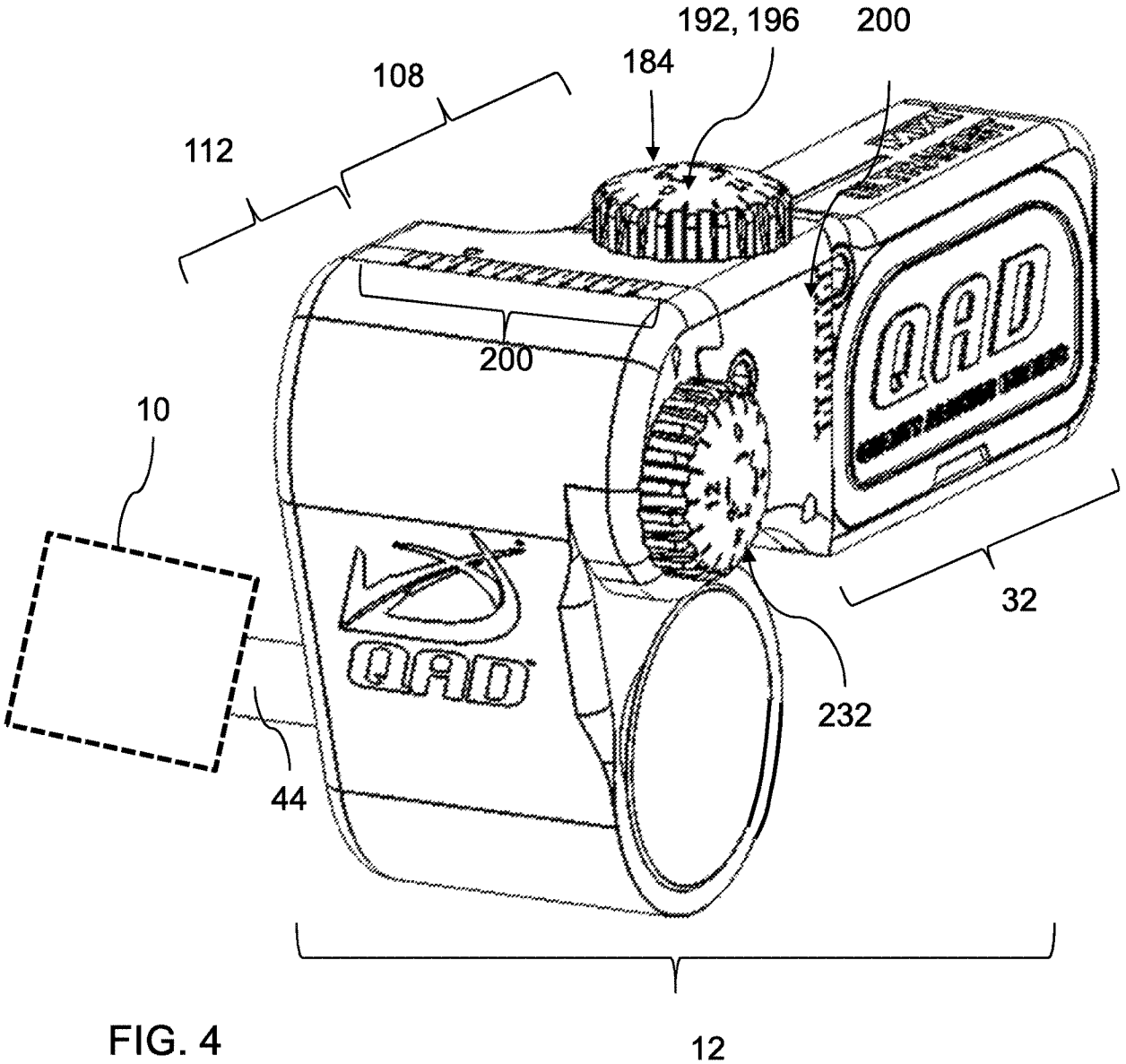
FIG. 4 is a rear isometric view of the bow accessory mounting system of FIG. 3

FIGS. 1-3 illustrate an embodiment of an archery bow 2. When the bow 2 is positioned for operation, the archery bow 2 has a front 14 facing in a forward direction 16 toward a shooting target 17 and a back 18 facing in a rearward direction 20 opposite the shooting target 17. The back 18 is positioned closer to an archer or user who readies the archery bow 2 in position to fire a projectile or arrow 24 (FIG. 3) along the shooting axis $A_S$ (FIG. 3).

The archery bow 2 includes a riser 6, which includes a plurality of side surfaces 22. At least a portion of the riser 6 extends along a riser axis $A_R$ (FIG. 3). The riser axis $A_R$ intersects a second plane 28, which intersects a bowstring plane 26. When the archery bow 2 is oriented or held upright in a vertical position, the riser axis $A_R$ is vertical. It should be understood that the term "vertical," as used herein, indicates a longitudinal or upright direction and does not necessarily require an axial position that is entirely normal or perpendicular to the plane 28.

A limb 8 is coupled to each end of the riser 6. A draw cord or bowstring 4 is coupled to the end of each limb 8. The bowstring 4 is movable within the bowstring plane 26. When the bowstring 4 is retracted and then released, an upright segment of the bowstring 4 moves forward within the bowstring plane 26. In an embodiment, a central point 30 of the bowstring 4 travels within the bowstring plane 26 to launch the arrow 24 along the shooting axis $A_S$. In an embodiment, the arrow 24 has a protrusion, tail or fletching (not shown) to aid in the aerodynamic flight performance of the arrow 24.

As illustrated in FIGS. 2-5, a bow accessory or accessory 10 can be attached or coupled to the bow riser 6 via an accessory mount or bow accessory mounting system 12. Depending upon the embodiment, the accessory 10 can include an arrow rest device, a sight device, a cable guard, a stabilizer, a vibration dampener, a flashlight or any other type of archery accessory or weaponry accessory. For example, the accessory 10 can be coupled to the riser 6 via the bow accessory mounting system 12. In an example, the bow accessory mounting system 12 can be coupled to a side surface 22 of the bow riser 6. In an embodiment, the accessory 10 is an arrow rest device 308 (FIGS. 33-37) that is coupled to or otherwise incorporates the bow accessory mounting system 12 such that the arrow rest device 308 holds the arrow 24 to direct the arrow 24 toward the target 17 (FIG. 1). In this embodiment, when the bow accessory mounting system 12 is coupled to the riser 6 and the bow 2 is in the operational position, the arrow rest device 308 is offset to the right or left of the bow accessory mounting system 12. This offset position locates the arrow holder 284 (FIGS. 33-36) into the user's field of vision or aiming zone to facilitate shooting.

Figure 5:
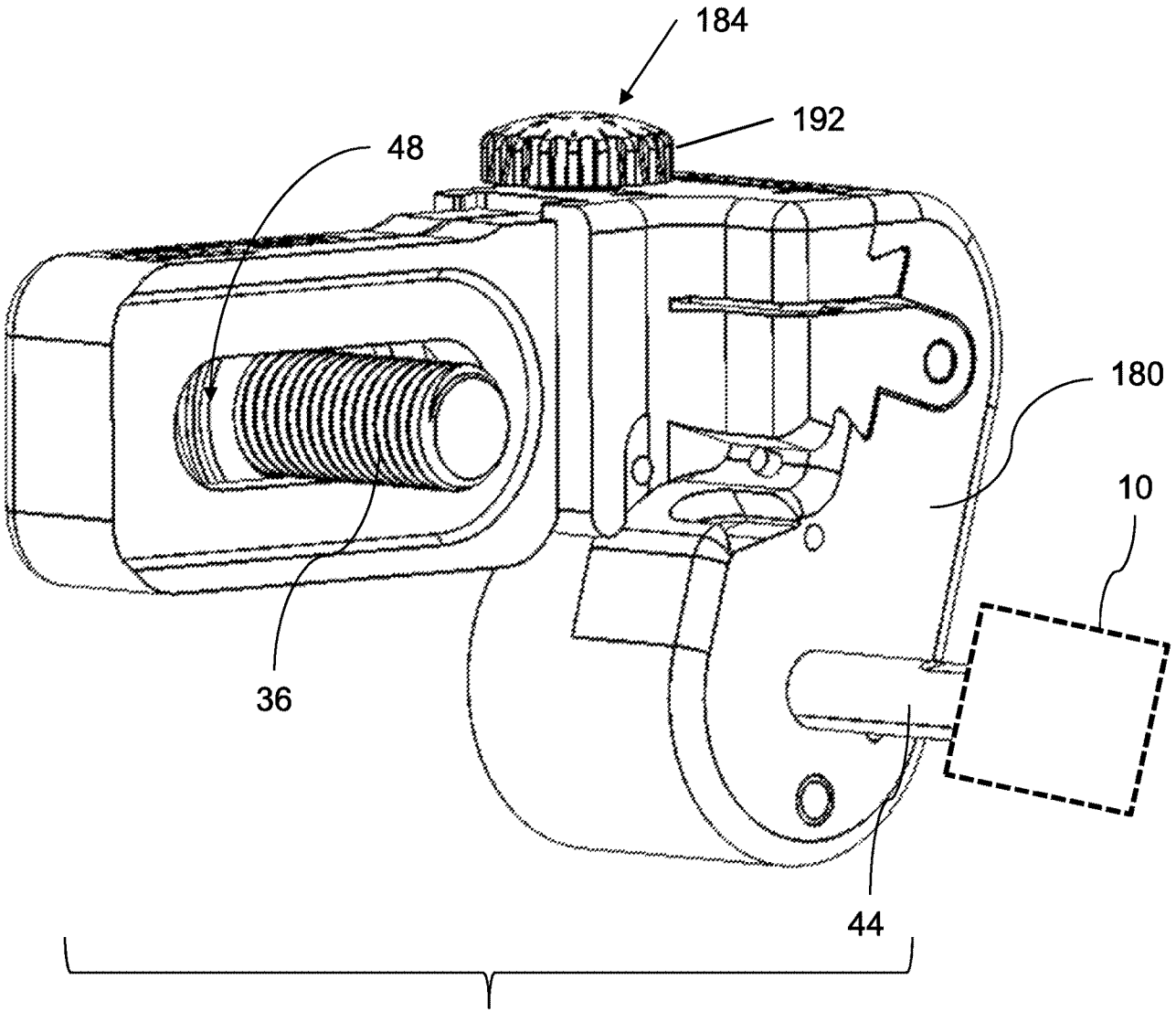
FIG. 5 is a front isometric view of the bow accessory mounting system of FIG. 3.
Figure 6:
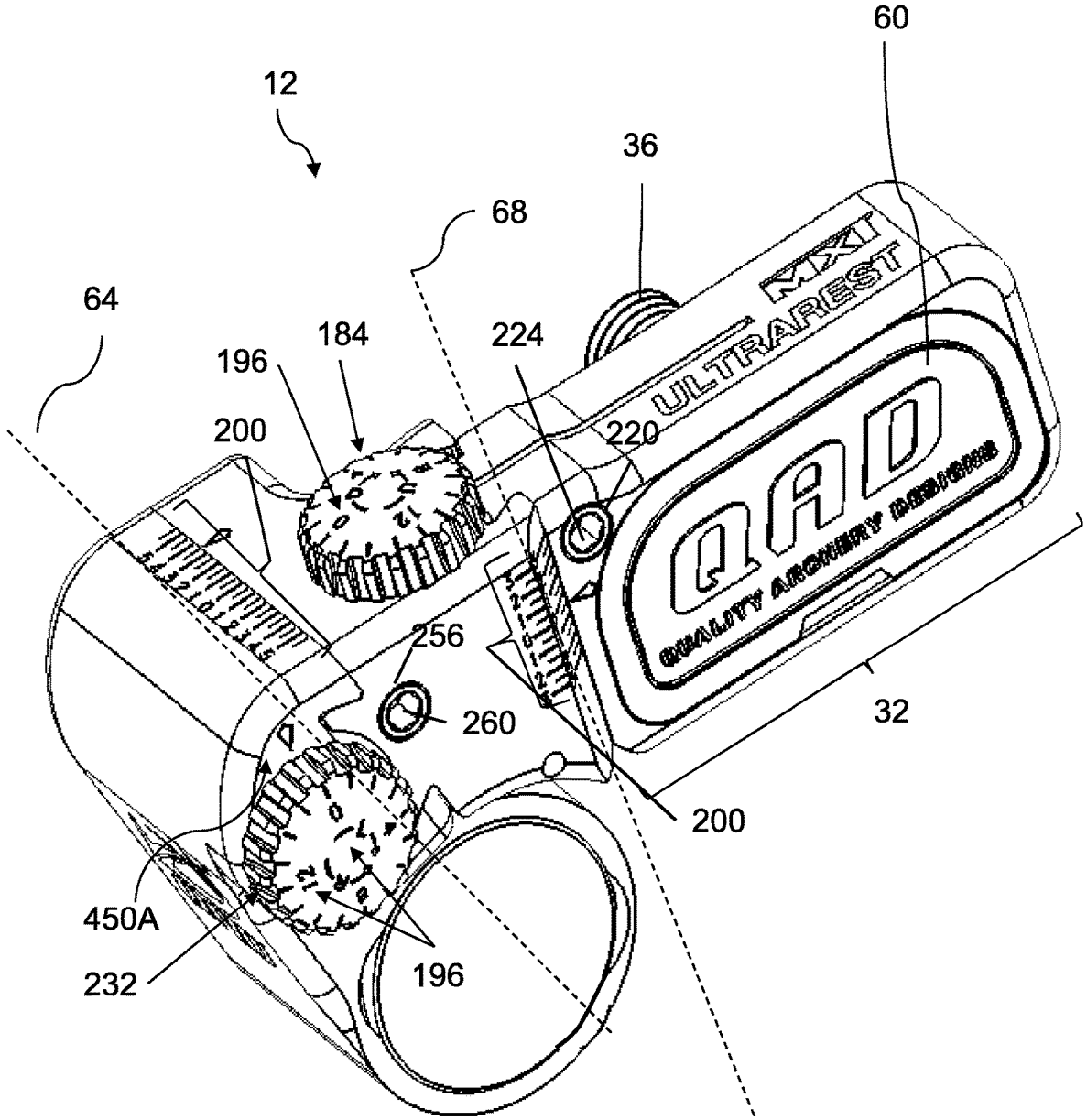
FIG. 6 is a top isometric view of the bow accessory mounting system of FIG. 3.
Figure 7:
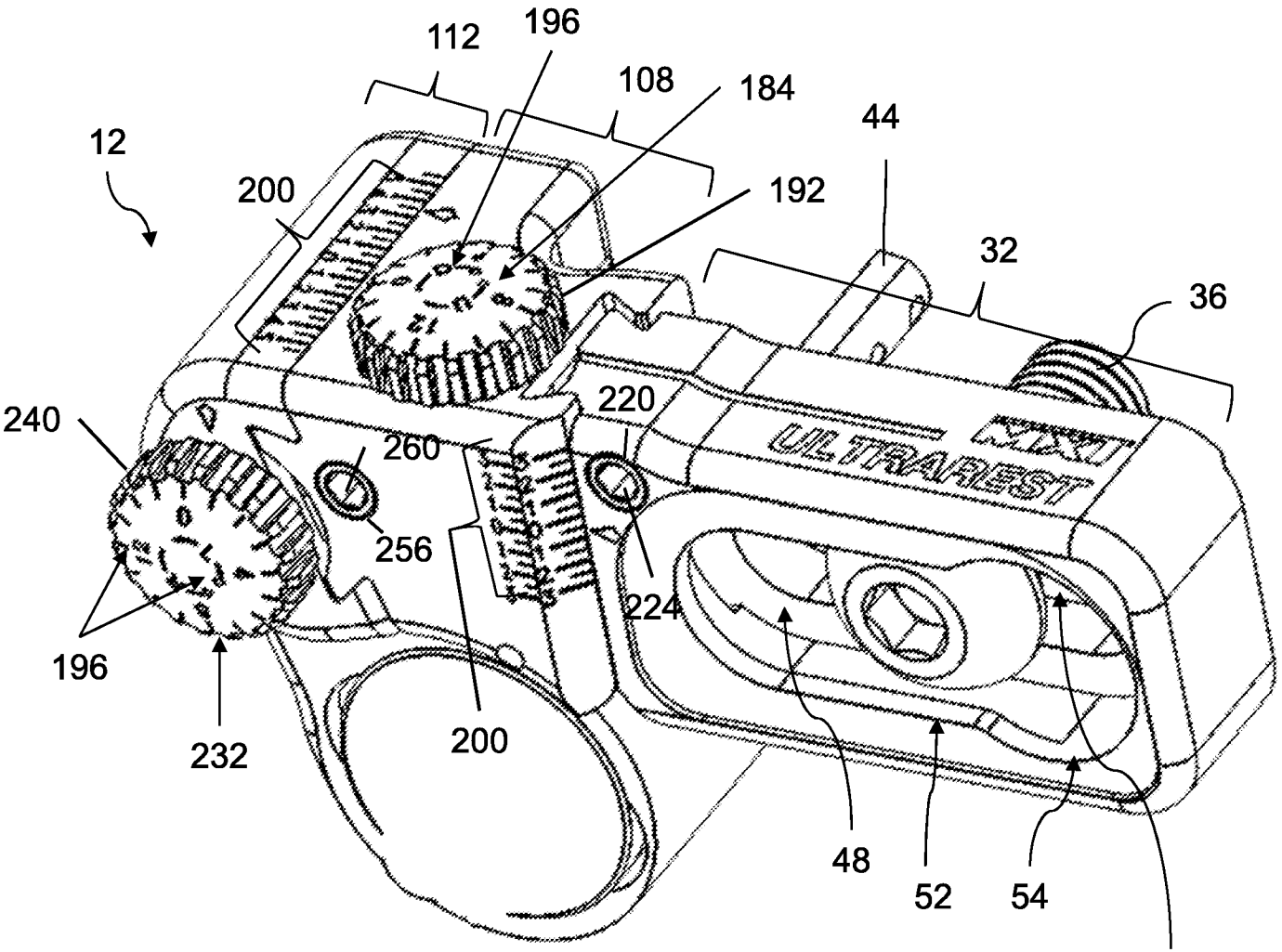
FIG. 7 is another top isometric view of the bow accessory mounting system of FIG. 3.
Figure 8:
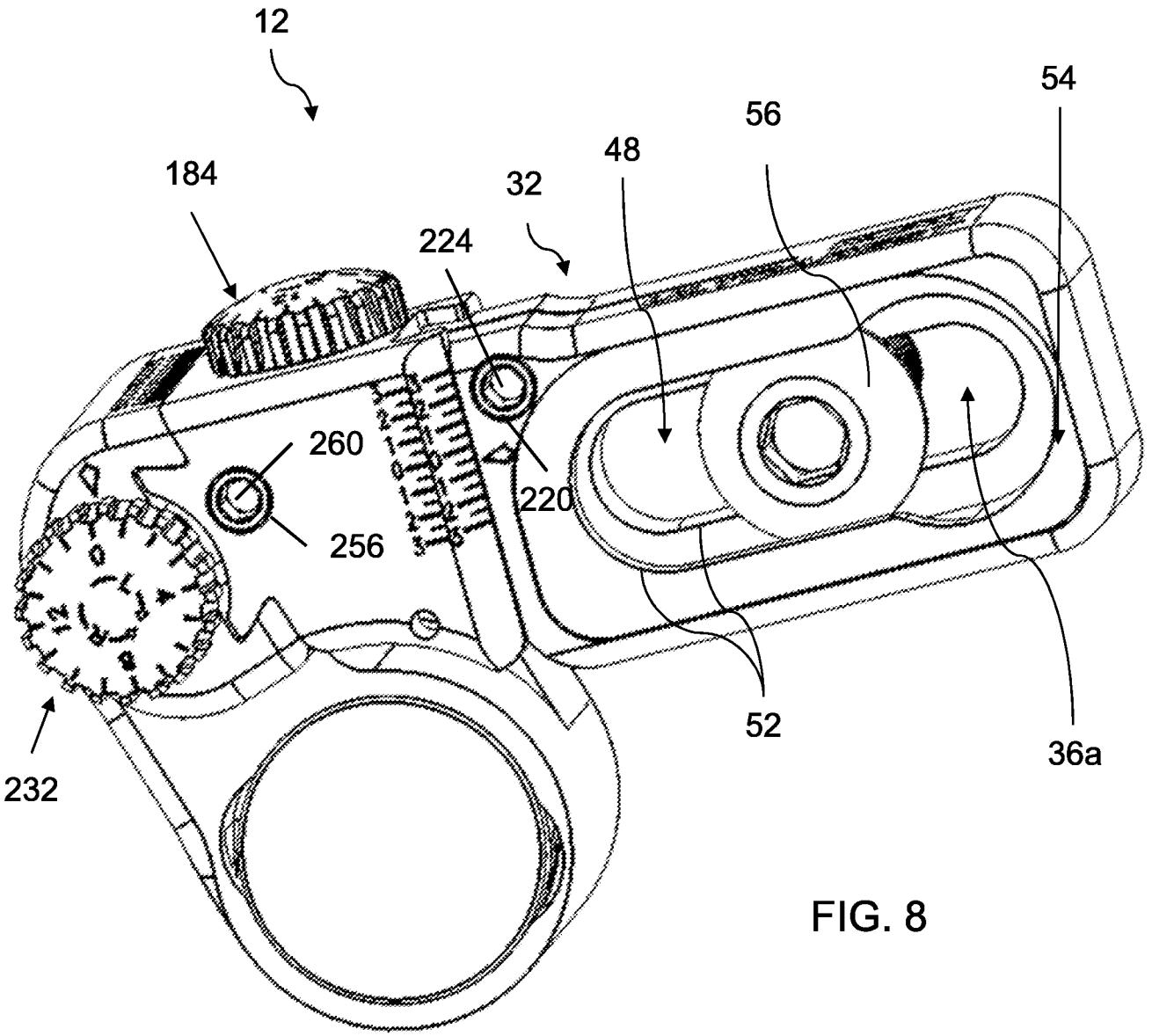
FIG. 8 is a side isometric view of the bow accessory mounting system of FIG. 3.
Figure 9:
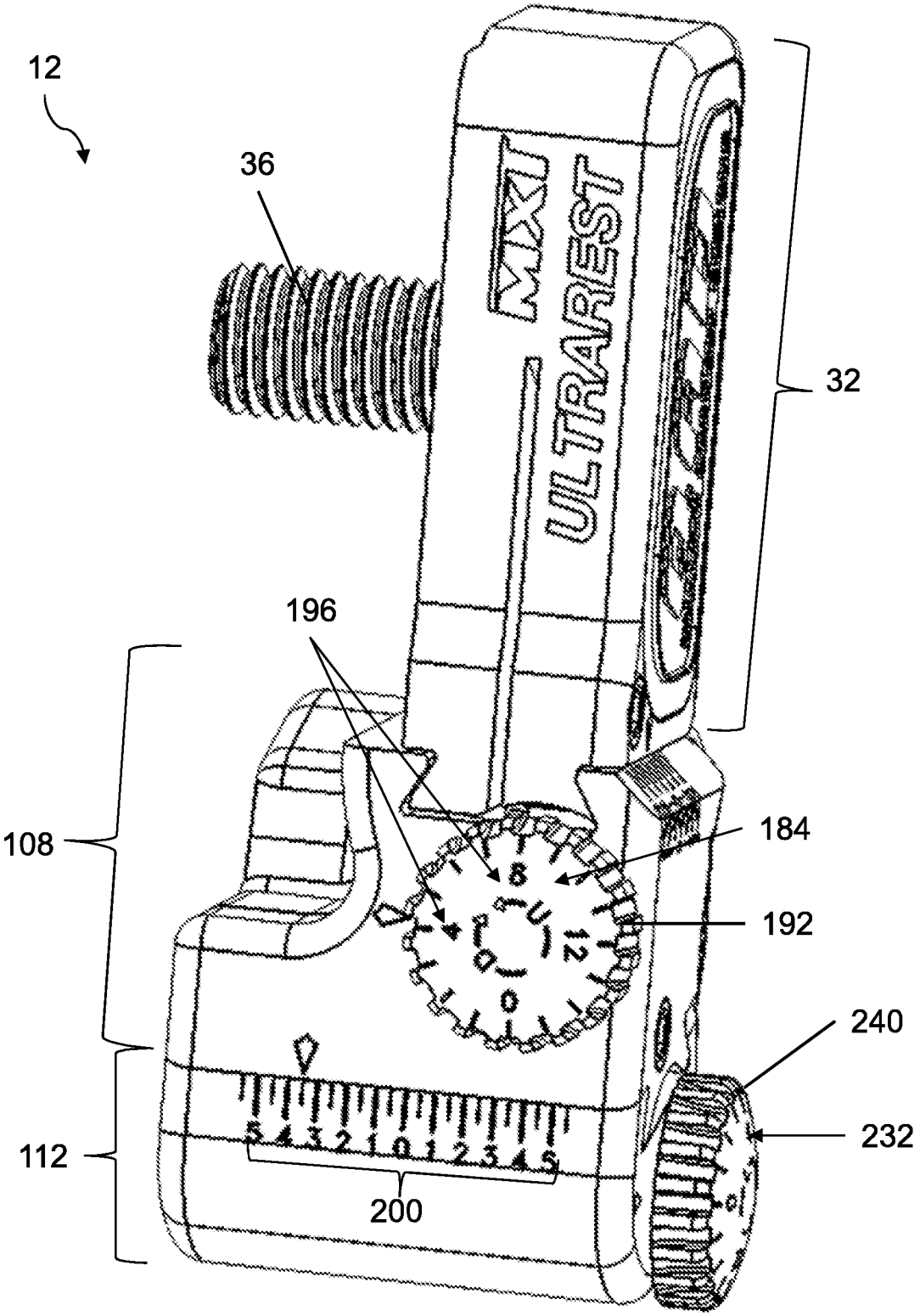
FIG. 9 is a top isometric view of the bow accessory mounting system of FIG. 3.

Referring to FIGS. 4-9, the bow accessory mounting system 12 includes a bow engagement portion or bow engager 32 to which the bow accessory 10, such as an arrow rest or sight, is coupled through an accessory support 44. The bow engager 32 is configured to be engaged with, and mounted to, the archery bow 2. For example, and as illustrated by FIGS. 7-8, a coupler 36, such as a threaded screw or bolt, is configured to couple the bow engager 32 to one of the mounting holes 40 (FIG. 1) extending through the riser 6 from a first side surface 22 to a second side surface 22. As illustrated by FIGS. 7-8, the bow engager 32 defines a step-shaped recess 48 extending entirely through the bow engager 32 in which the coupler 36 is positioned. In an embodiment, the recess 48 has an exterior lip 52 encircling the recess 48 such that the exterior dimensions of the recess 48 are smaller than the interior dimensions of the recess 48 to retain the head 56 of the coupler 36 within the interior recess 48. In addition, in this embodiment, a portion 54 of the exterior lip 52 is enlarged, corresponding to the size of the head 56 of the coupler 36 to enable to the coupler 36 to be inserted in the recess 48 and through the pass-through opening 36*a* (FIGS. 7-8). In an embodiment, when the coupler 36 is positioned in the recess 48, an informative and protective cover 60, such as a logo cover, is positioned over the coupler 36 and the recess 48. In an example, this protective cover 60 can both provide information by bearing markings or words, and it can assist in retaining the coupler 36 in the recess 48 and in shielding the coupler 36 and recess 48 from environmental elements.

Figure 10:
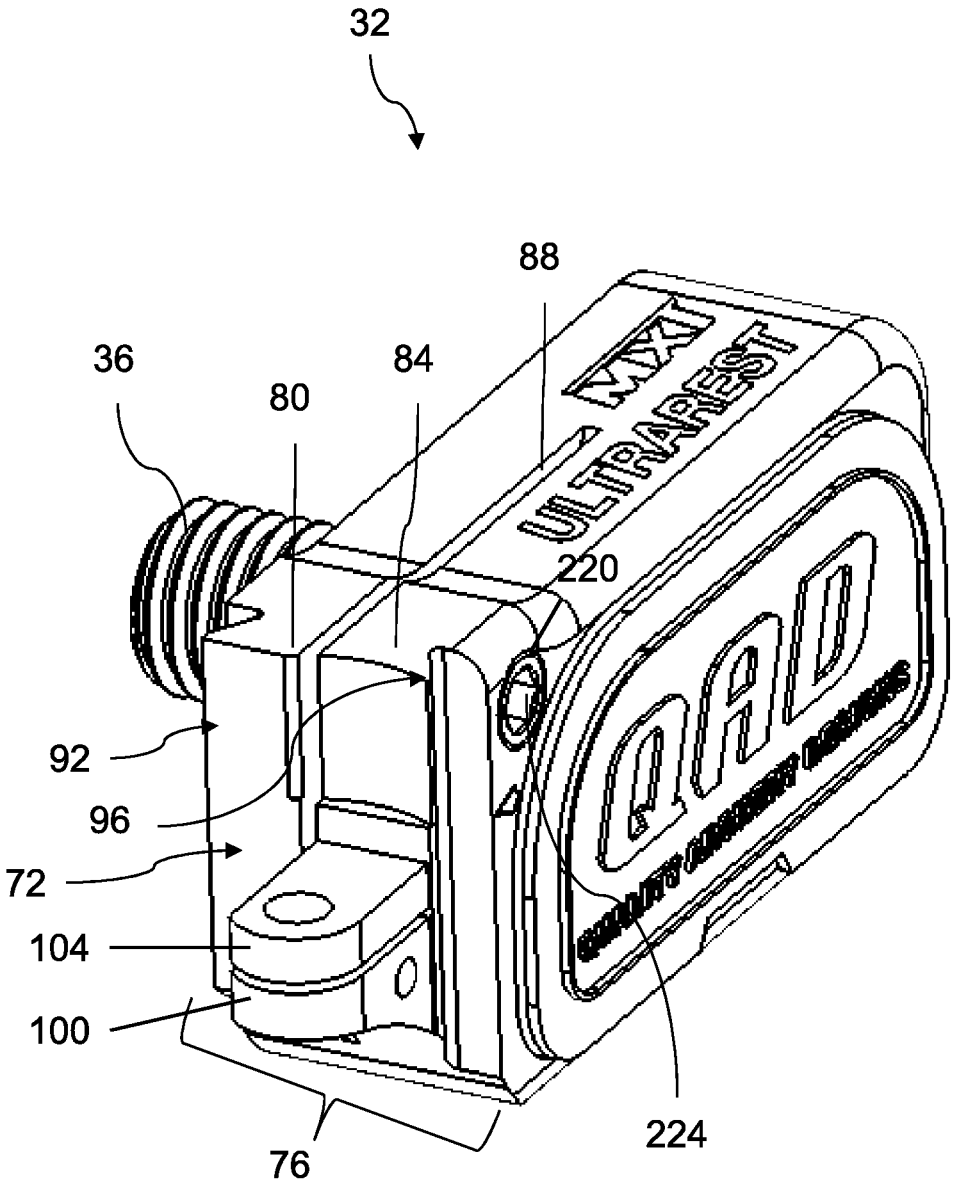
FIG. 10 is a rear isometric view of the bow engager of the bow accessory mounting system of FIG. 3.

Referring to FIG. 10, the rear surface 72 of the bow engager 32 has a male dovetail-shaped portion 76 extending along the vertical axis or vertical adjustment axis 68 (FIG. 6). The male dovetail-shaped portion 76 includes a first portion 80 and a second portion 84 extending along the vertical axis 68. The first portion 80 includes a first lip or undercut extension surface 92 and the second portion 84 includes a second lip or undercut extension surface 96, each of the first and second lip extending the length of the male dovetail-shaped portion 76 along the vertical axis 68. The first portion 80 and second portion 84 are separated by a slit or narrow recess 88 extending through the bow engager 32. As further described below, coupled to and extending from the rear surface 72 are a vertical adjuster support or vertical support 100 and a vertical biaser 104.

Figure 11:
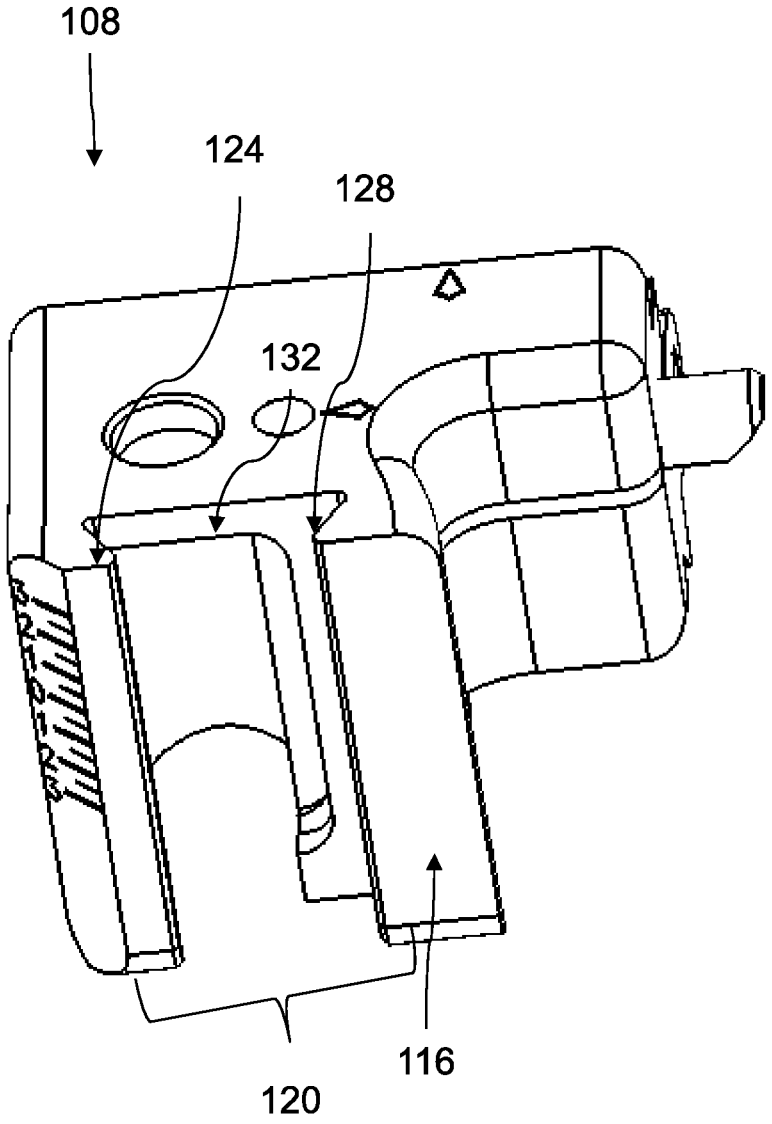
FIG. 11 is a front isometric view of the vertical adjuster of the bow accessory mounting system of FIG. 3.

Referring back to FIGS. 4-9, in the illustrated embodiment, the bow accessory mounting system 12 includes a front body section or vertical adjuster 108 and a rear body section or lateral adjuster 112. As illustrated in FIG. 11, the front surface 116 of the vertical adjuster 108 includes a female dovetail-shaped portion 120 extending along the vertical axis 68 (FIG. 6) and corresponding to and configured to mate with and engage the male dovetail-shaped portion 76 (FIG. 10) of the bow engager 32. The female dovetail-shaped portion 120 of the vertical adjuster 108 is formed by a first inwardly oriented lip or extension surface 124 and a second inwardly oriented lip or extension surface 128 which together define a recess or opening 132 corresponding to the shape of the male dovetail-shaped portion 76 of the bow engager 32.

Figure 12:
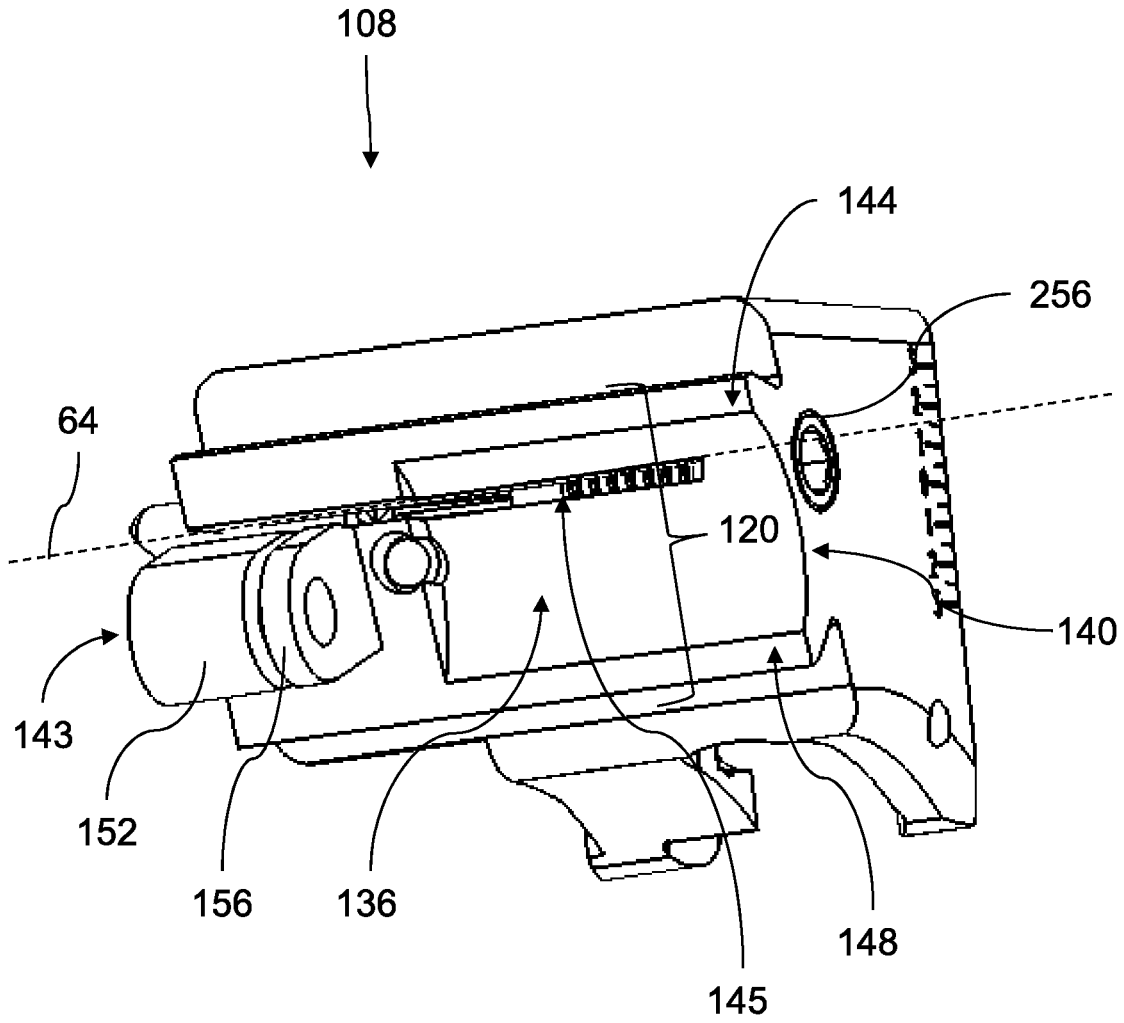
FIG. 12 is a rear isometric view of the vertical adjuster of FIG. 11.

Referring to FIG. 12, the rear surface 136 of the vertical adjuster 108 includes a male dovetail-shaped portion 140 extending along the lateral axis or lateral adjustment axis 64 (FIG. 6). The male dovetail-shaped portion 140 is defined by a first outwardly oriented lip or extension surface 144 and a second outwardly oriented lip or extension surface 148 positioned opposite the first lip 144. As further described below, a lateral adjuster support or lateral support 152 and lateral biaser 156 extend from or are otherwise coupled to the rear surface 136.

Figure 13:
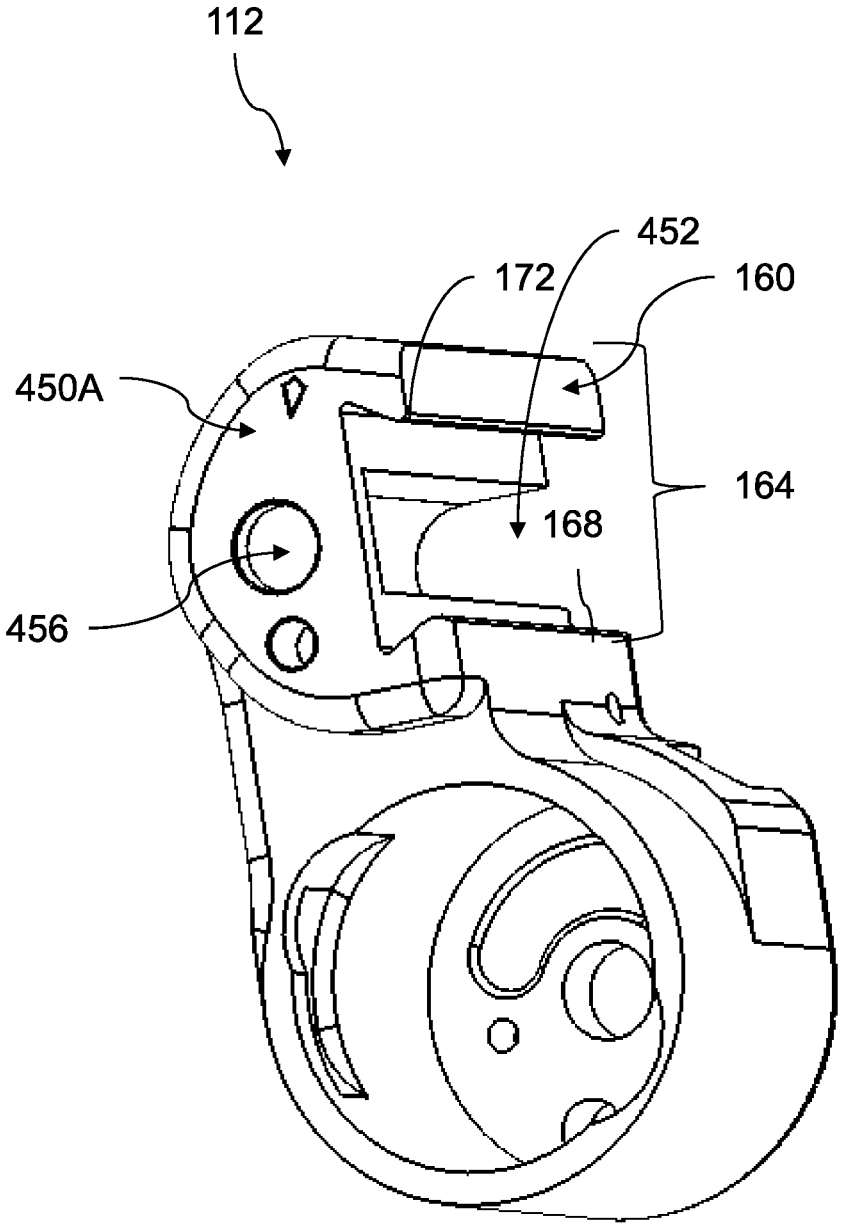
FIG. 13 is a side isometric view of a lateral adjuster of the bow accessory mounting system of FIG. 3.
Figure 14:
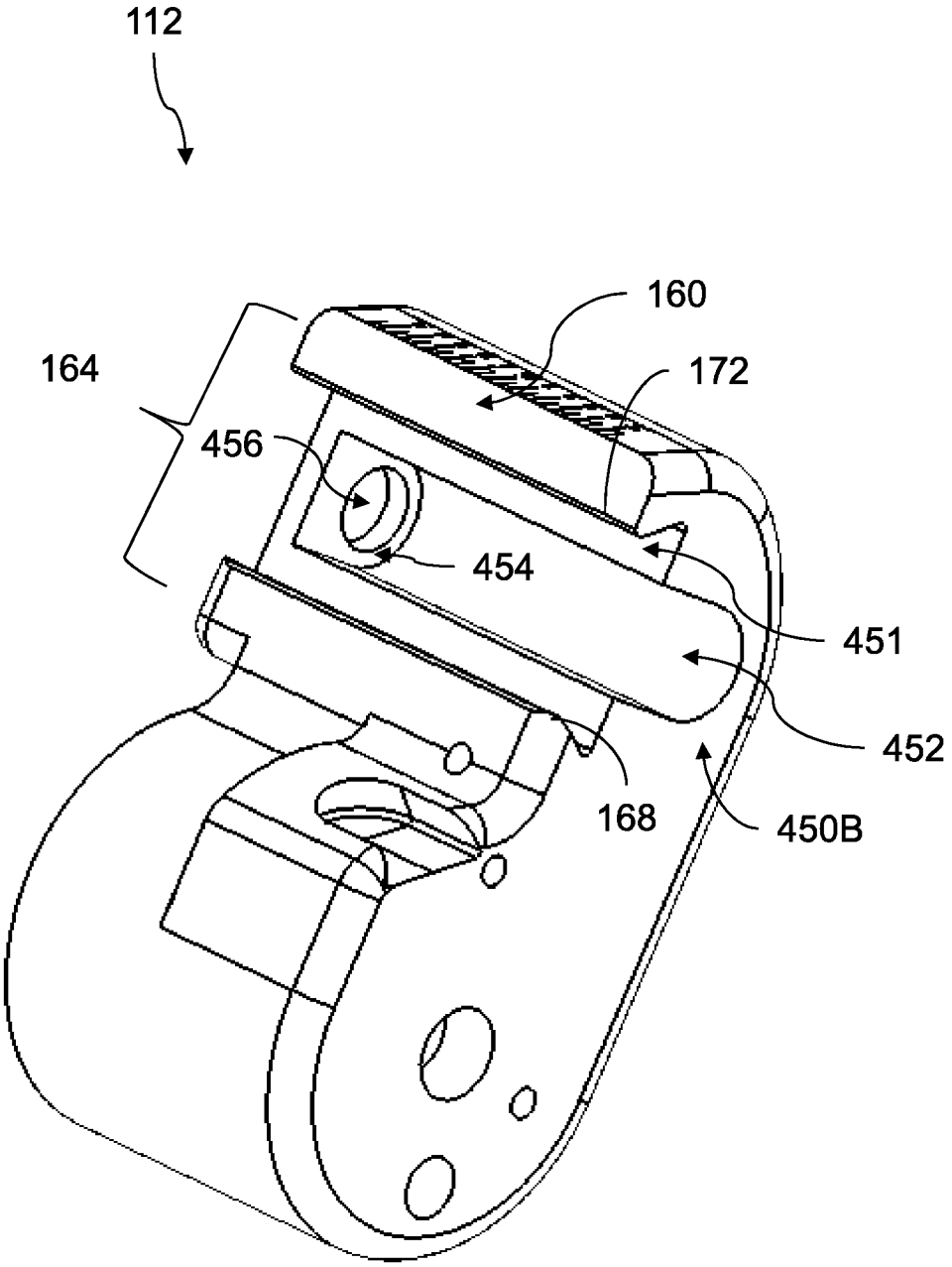
FIG. 14 is a front isometric view of the lateral adjuster of FIG. 13.

Referring to FIGS. 13-14, the front surface 160 of the lateral adjuster 112 includes a female dovetail-shaped portion 164 extending along the lateral axis 64 (FIG. 6) and corresponding to and configured to engage the male dovetail-shaped portion 140 (FIG. 12) of the vertical adjuster 108. The female dovetail-shaped portion 164 of the lateral adjuster 112 is formed by a first inwardly oriented lip or extension surface 168 and a second inwardly oriented lip or extension surface 172 which together define a recess or opening 176 corresponding to the shape of the male dovetail-shaped portion 140 of the vertical adjuster 108. As illustrated by FIG. 5, an accessory support 44, configured to support a bow accessory 10, extends from a side surface 180 of the lateral adjuster 112.

As illustrated by FIGS. 4-9, a vertical driver 184 is positioned in the vertical adjuster 108. As further illustrated by FIG. 17, in an embodiment, the vertical driver 184 has a threaded shaft 188 (e.g., a threaded screw or bolt) that rotatably engages the vertical support 100. In an embodiment, the threaded shaft 188 has a three lead thread pitch. In an example, the threaded shaft 188 uses imperial #6-32 threads.

Figure 18:
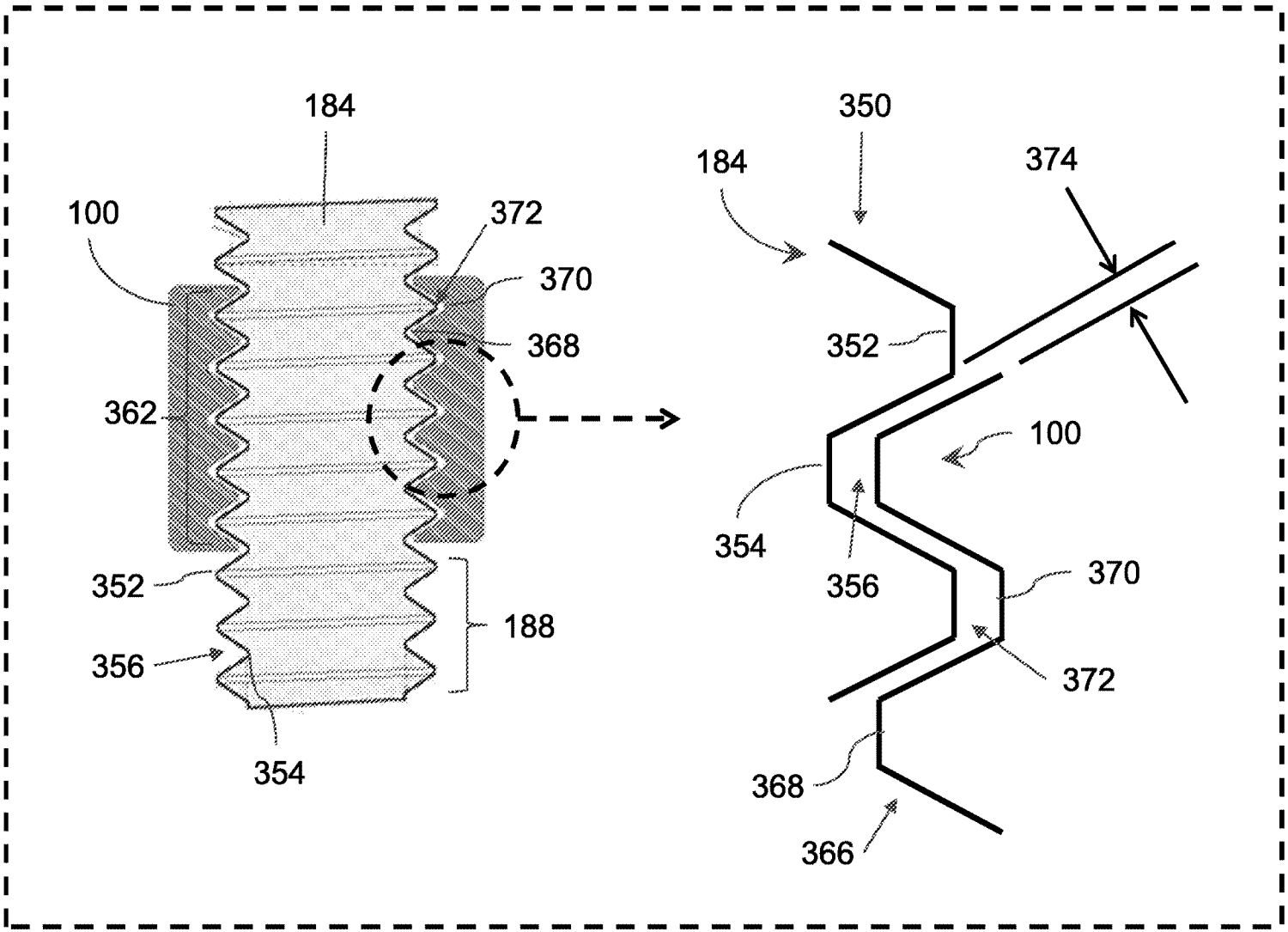
FIG. 18 is a schematic diagram illustrating the thread interaction between the vertical driver and the vertical support of the bow accessory mounting system of FIG. 3, illustrating the slop or play that occurs without the functionality of the biaser.
Figure 19:
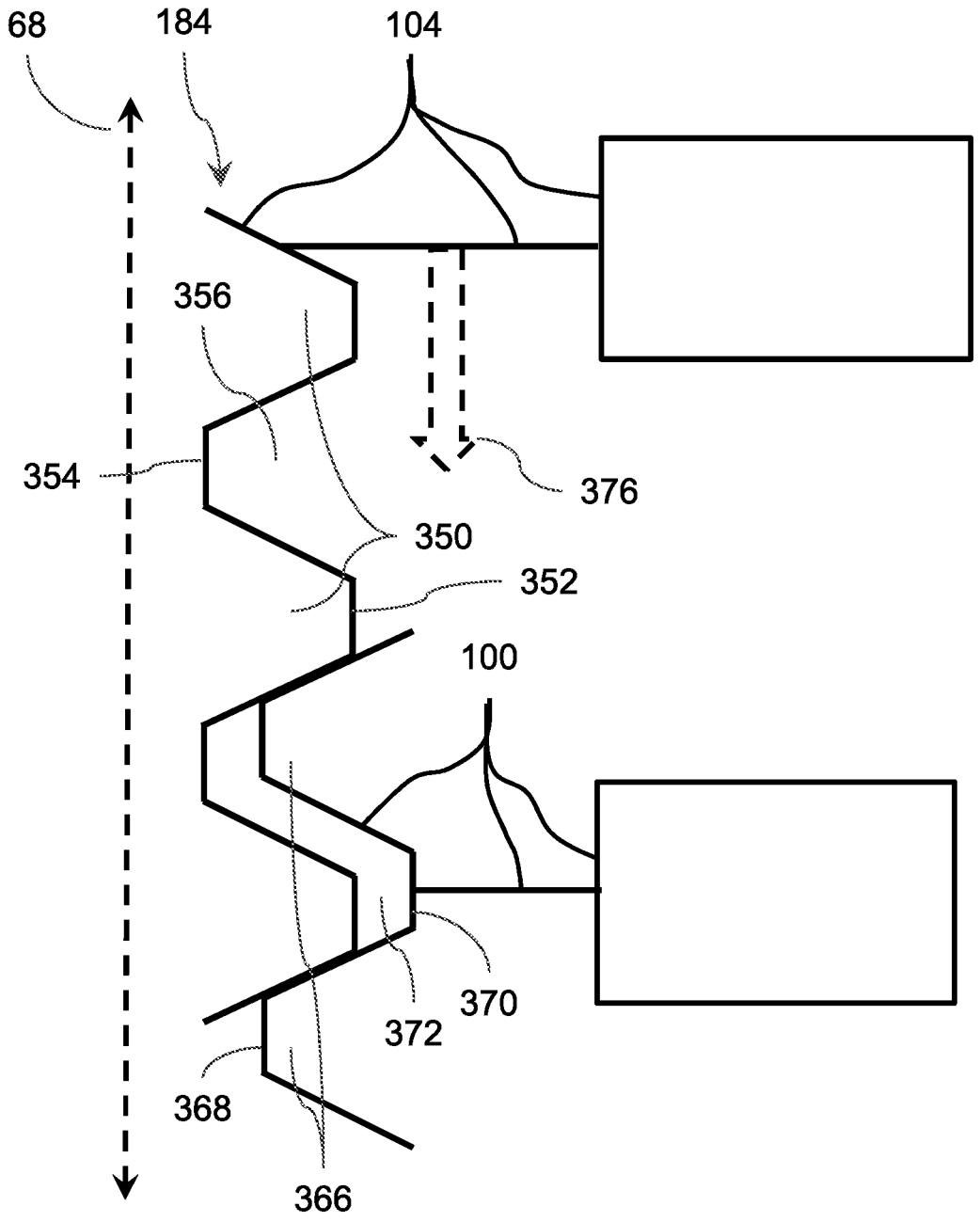
FIG. 19 is a schematic diagram illustrating the force applied by the biaser of the bow accessory mounting system of FIG. 3 to maintain constant or continuous, thread-to-thread contact.
Figure 20:
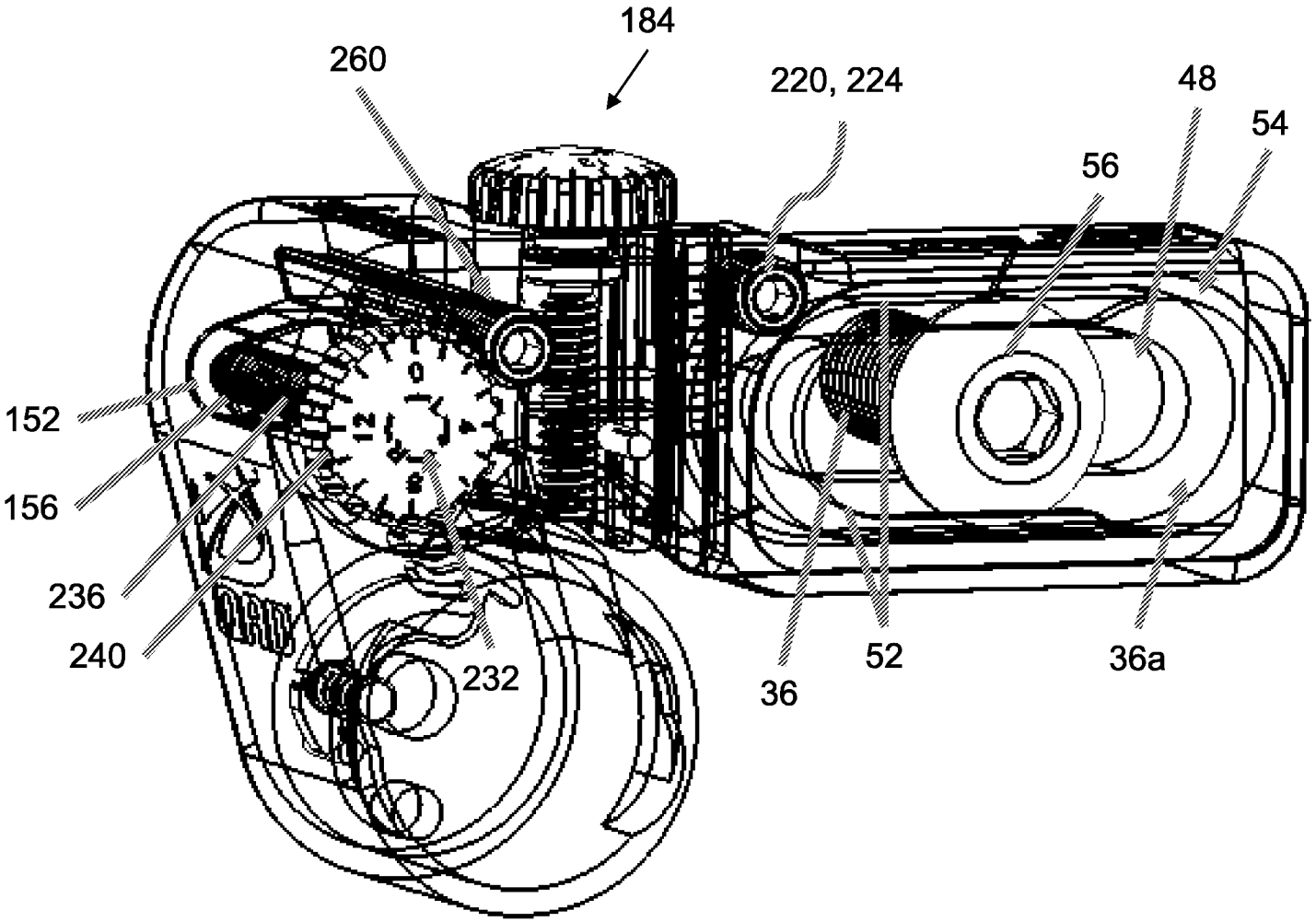
FIG. 20 is a side isometric view of the bow accessory mounting system of FIG. 3, showing the internal components.
Figure 21:
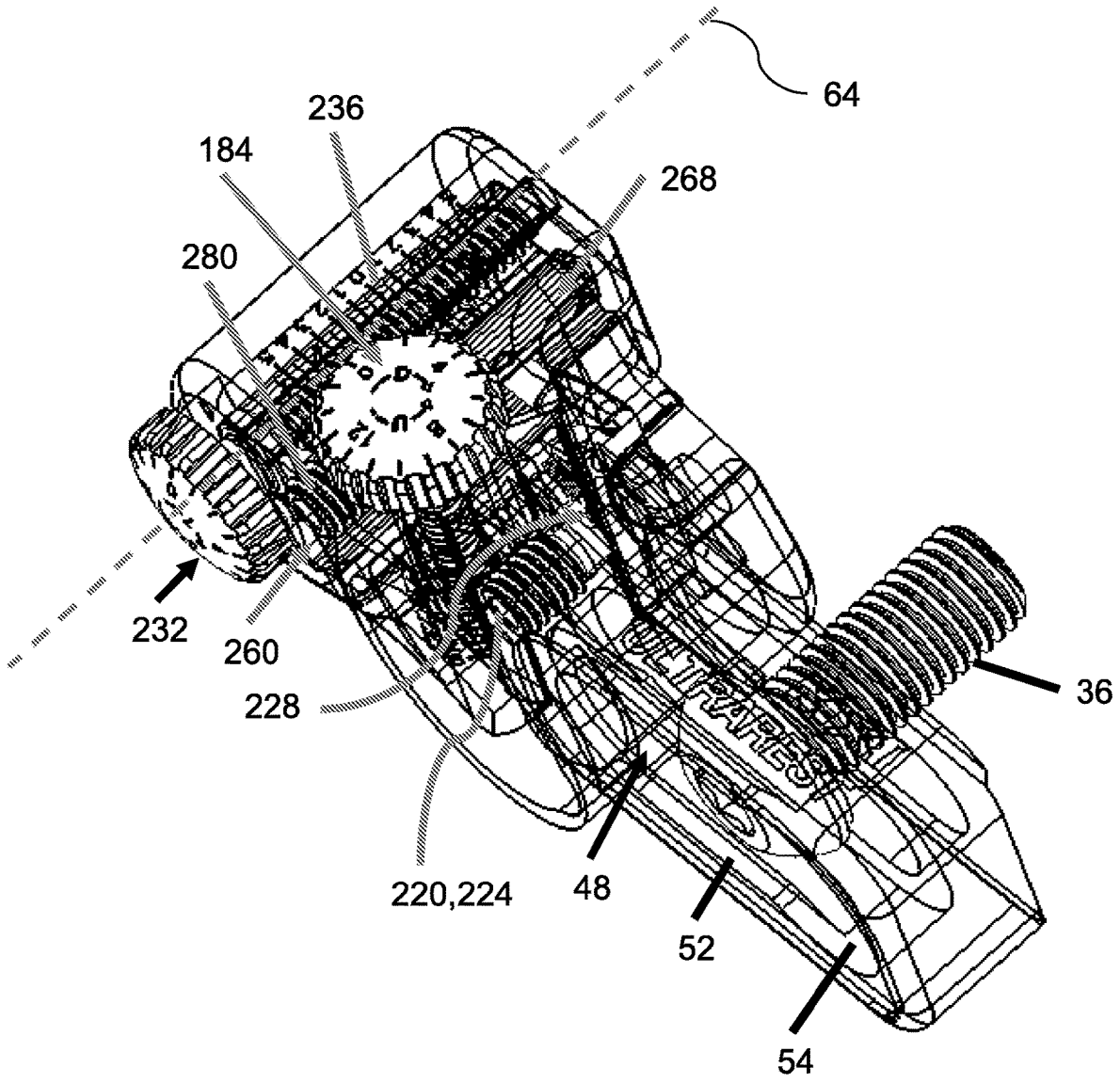
FIG. 21 is a top isometric view of the bow accessory mounting system of FIG. 3, showing the internal components.
Figure 22:
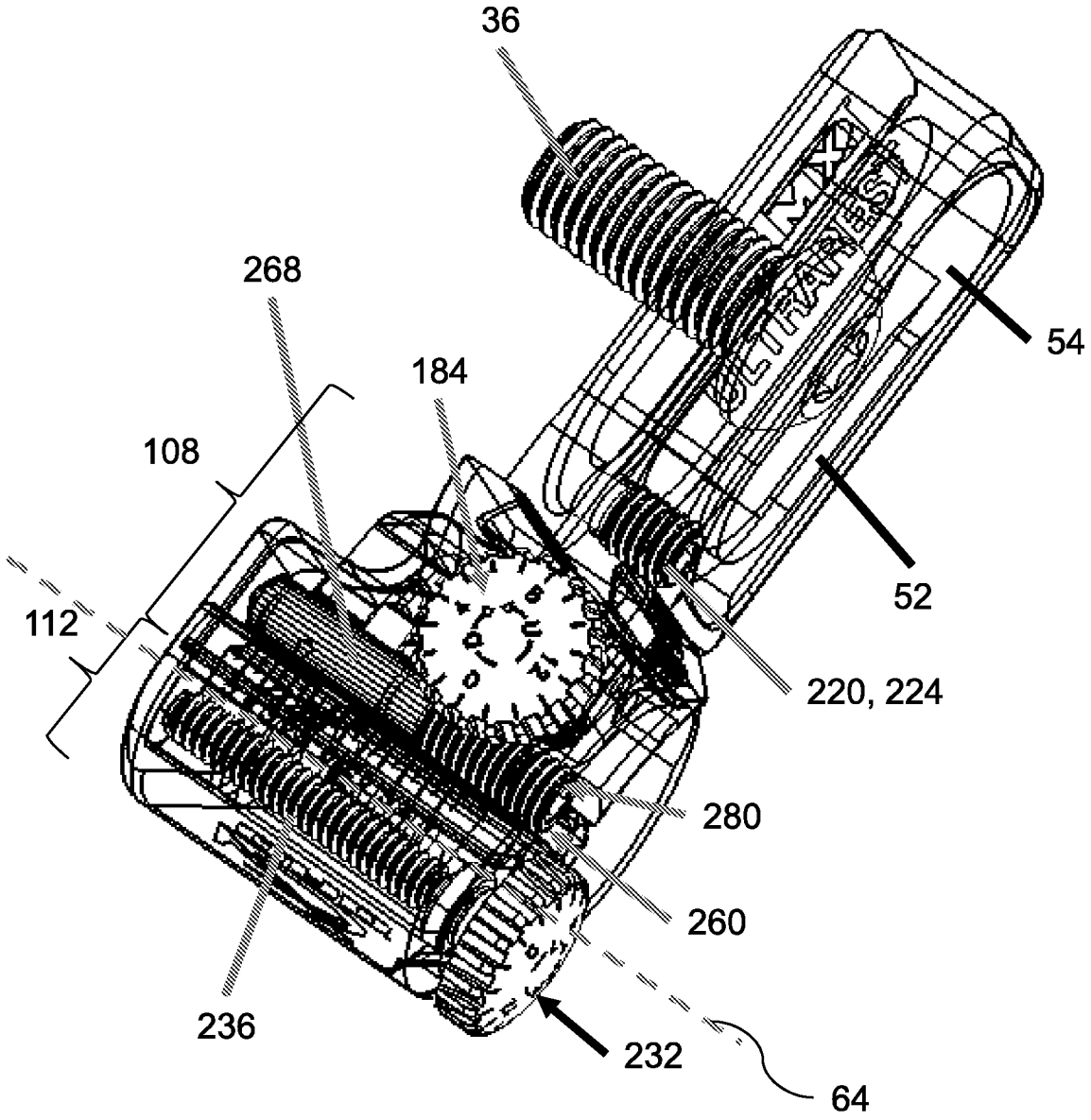
FIG. 22 is another top isometric view of the bow accessory mounting system of FIG. 3, showing the internal components.
Figure 23:
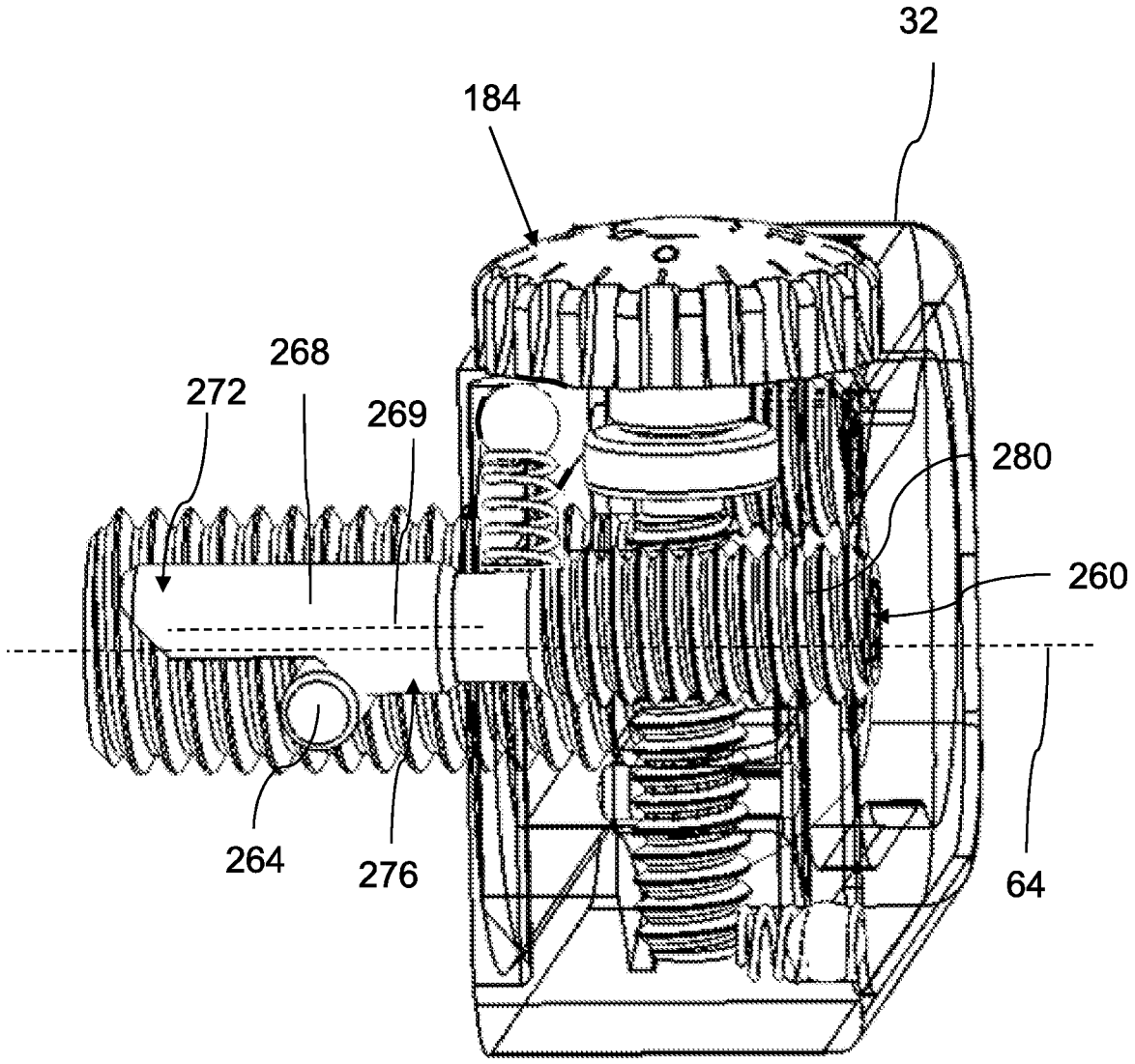
FIG. 23 is a cutaway rear isometric view of an embodiment of a locking system of the bow accessory mounting system of FIG. 3.
Figure 24:
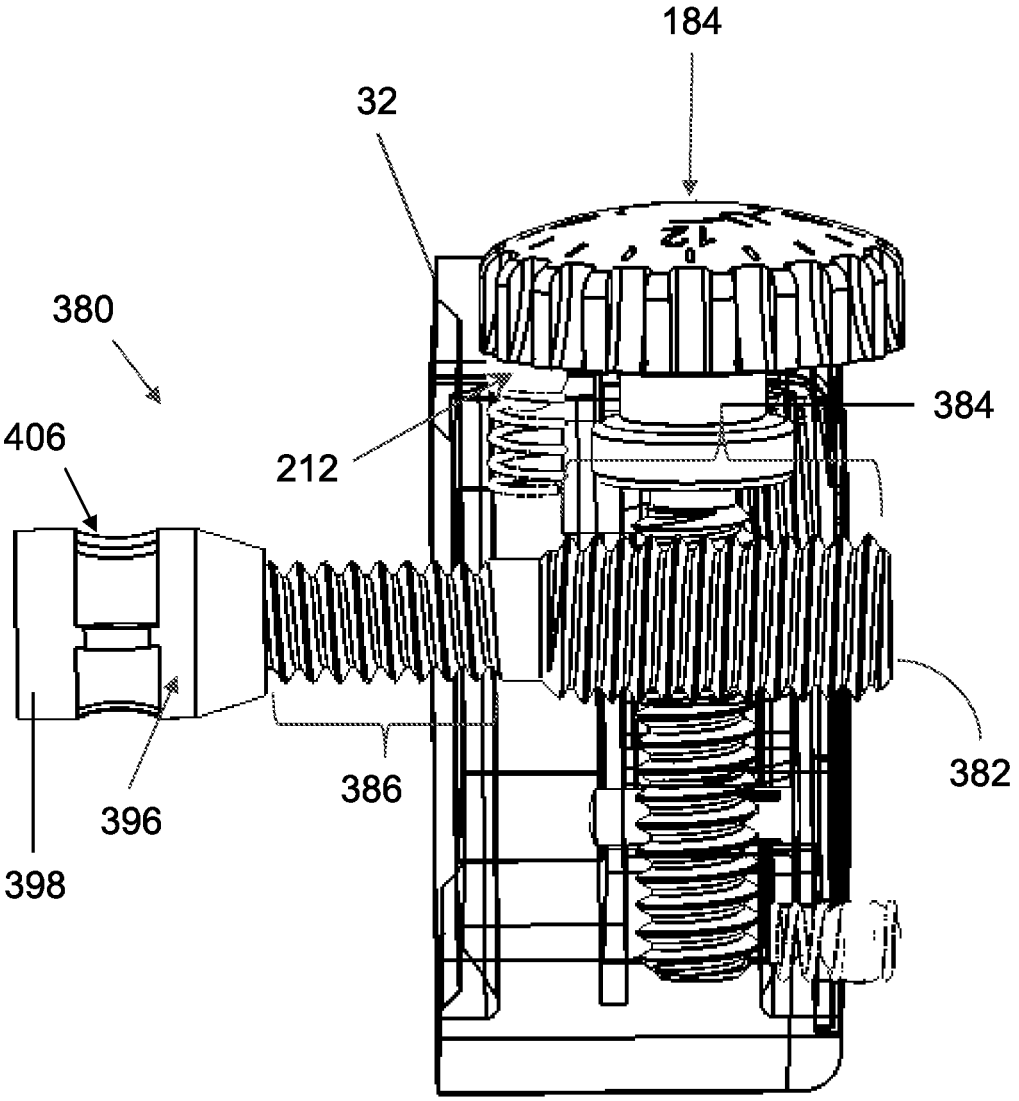
FIG. 24 is a cutaway rear isometric view of another embodiment of a locking system of the bow accessory mounting system of FIG. 3.
Figure 25A:
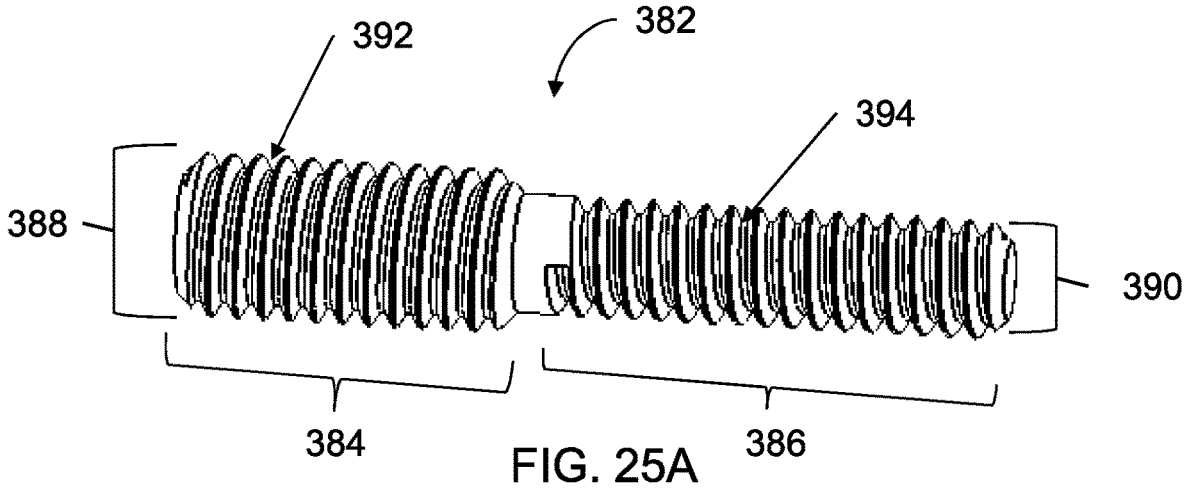
FIG. 25A is a side view of an embodiment of a locking member of the bow accessory mounting system of FIG. 3.
Figure 25B:
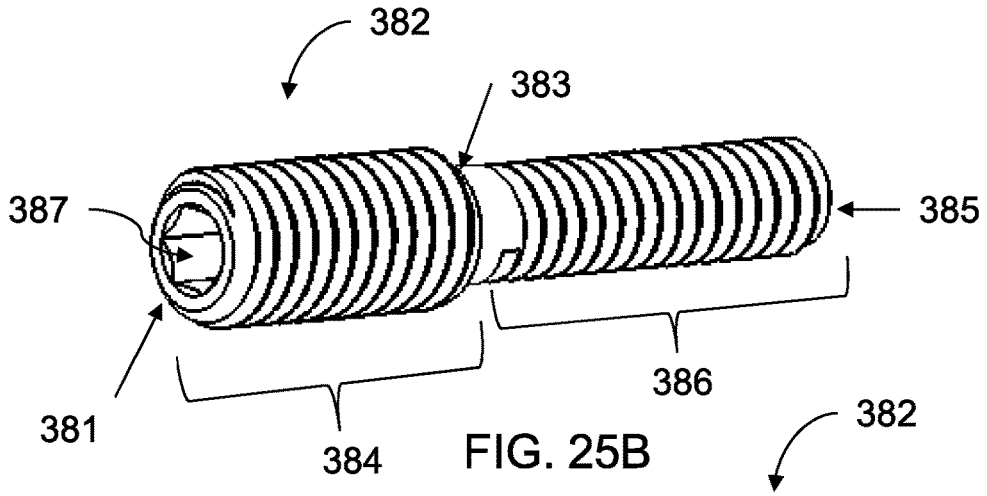
FIG. 25B is a side isometric view of the locking member of FIG. 25A.
Figure 25C:
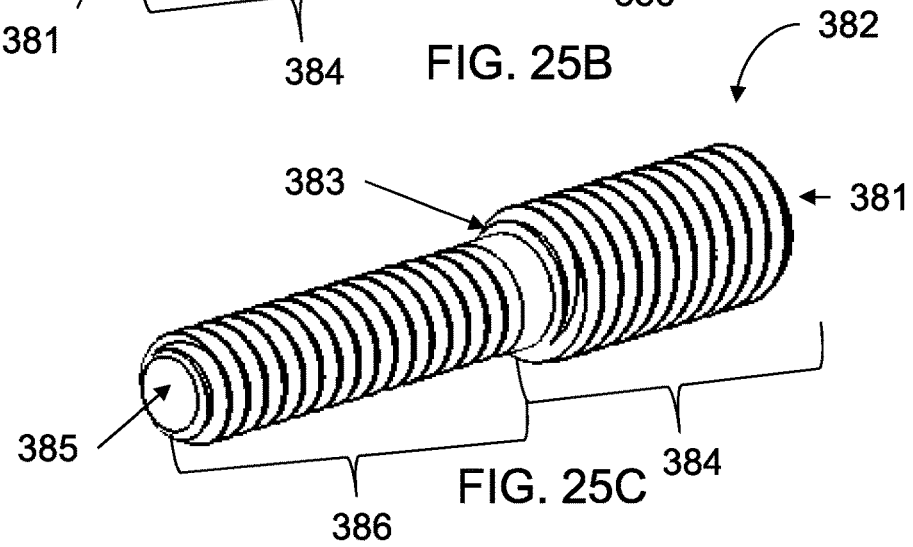
FIG. 25C is another side isometric view of the locking member of FIG. 25A.

The threaded shaft 188 threadably engages the vertical support 100 and the vertical biaser 104, as further illustrated by FIGS. 18-19. In this embodiment, the vertical support 100 and the vertical biaser 104 are each threaded. With reference to FIGS. 18-19, the threaded shaft 188 of the vertical driver 184 has a plurality of driver threads 350, spaced apart from each other to define a plurality of driver thread crests or driver crest surface 352 and driver thread roots or valleys or driver root surfaces 354, with a driver gap 356 extending between adjacent thread crests 352.

Figure 17:
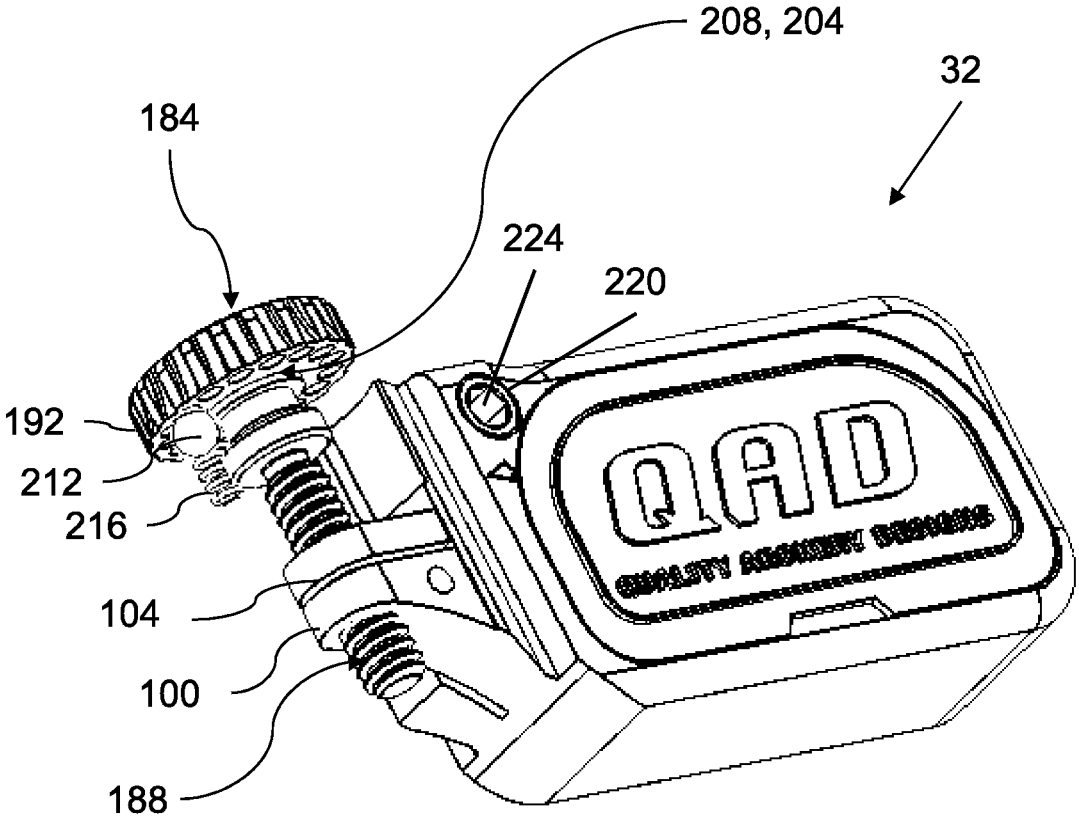
FIG. 17 is side isometric view of the bow engager of FIG. 10, with a vertical driver.

In addition, the vertical support 100 and the vertical biaser 104, extending parallel to each other in the embodiment illustrated in FIG. 17, each have an aperture 358, 360 extending therethrough, with each aperture 358, 360 having an interior, threaded surface 362, 364. With particular reference to the vertical support 100 and aperture 360, and similar to the threaded surface 188 of the vertical driver 184, the threaded surface 362 of the vertical support aperture 360 has a plurality of threads 366 spaced apart from each other to define a plurality of support thread crests or support crest surfaces 368 and a plurality of support thread roots or valleys or support root surfaces 370 between or opposite the support thread crests 368, with a support gap 372 extending between adjacent support thread crests 366. The aperture 360 of the vertical biaser 104 can define similar threads.

As illustrated in FIGS. 18-19, when the vertical driver 184 is retained within the support aperture 350, the threaded surfaces 188, 362 of the vertical driver 184 and support aperture 358 engage each other such that the crests 352 of the driver threads 350 rest in the gaps 372 of the support threads 366, and the crests 368 of the support threads 366 rest in the gaps 356 of the driver threads 350. The vertical biaser 104 can similarly engage the threaded surface 188 of the vertical driver 184.

As illustrated in FIG. 18, when the crests 352, 368 of the threads 350, 366 are positioned within the thread gaps 356, 372, there can be a gap or space 374 between the driver threads 350 and the support threads 366, typically referred to as "slop" resulting in "play" or looseness between the threads 350, 366. The space 274 and such looseness can occur if there is no vertical biaser 104. For example, if the vertical driver 184 was rotated without the functionality of the vertical biaser 104, the initial part of the rotation would be necessary to close this gap or space 374 so that the threads 350, 366 make physical contact with each other. Only after the threads 350, 366 are in physical contact would the rotation of the vertical driver 184 result in movement of the vertical adjuster 108. This initial rotation of the vertical driver 184 before actual movement of the vertical adjuster 108 can result in a decrease in control over the fine tune, positional adjustments. This is because a user may think that any rotation of the vertical driver 184 causes a movement of the vertical adjuster 108, not knowing or remembering that there is an initial part of the rotation that occurs before there is any movement of the accessory 10, or not knowing or remembering how much rotation of the vertical driver 184 occurs before movement of the vertical adjuster 108 occurs. In other words, the looseness between the threads 350, 366 can cause a delay in the reaction of the accessory 10 to adjustments by the user. This delay can make it difficult to incrementally control the adjustment of the accessory 10.

As illustrated in FIG. 19, the vertical biaser 104 provides an improvement that overcomes, or lessens the effects of, these disadvantages. The vertical biaser 104 is configured to generate or exert a biasing force or vertical force 376 acting on the vertical driver 184 along the vertical axis 68. This force 376 urges the driver threads 350 to move along the vertical axis 68 into direct physical contact with the support threads 358. This force 376 establishes and maintains direct, physical contact between the driver threads 350 and the support threads 358. In an embodiment, this physical contact is constant or continuous based on the constant biasing generated by the vertical biaser 104. Due to the maintenance of this physical contact, there is no gap 374 (FIG. 18) between the driver threads 350 and the support threads 358. Thus, in an embodiment, the vertical force 376 acts to overcome "slop" or "play" in the movement of the vertical driver 184 so that any amount of rotation of the vertical driver 184 directly results in immediate movement of the vertical adjuster 108. Due to this immediate movement, a user has increased control over performing and repeating fine tune adjustments because there is no period of rotation before actual movement of the vertical adjuster 108 for which the user must account.

In an embodiment, the vertical force 376, acting downward toward the vertical support 100, is a compressive force that pushes or presses the driver threads 350 into contact with the support threads 358. This results in the compression of a portion of the vertical driver 184. In another embodiment not shown, the vertical force 376, acting upward away from the vertical support 100, is a tensile force that pulls the driver threads 350 into contact with the support threads 358. This puts a portion of the vertical driver 184 under tension.

Referring back to FIG. 17, in the illustrated embodiment, the vertical support 100 and the vertical biaser 104 are parallel and adjacent to each other in the form of a "split nut," with the vertical biaser 104 flexing relative to the vertical support 100. In another embodiment, the vertical biaser 104 is a leaf spring or has a spring characteristic or other biasing member that is predisposed to exert such axial vertical force 376 on the vertical driver 184 during the rotation of the vertical driver 184. In another embodiment, not illustrated, the vertical biaser 104 and/or the vertical support 100 has a deformable insert (not shown). Depending upon the embodiment, the deformable insert can include a nylon insert that engages with the threads of the vertical driver 184. While FIGS. 18-19 have been described here with specific reference to the vertical support 100, vertical biaser 104, and vertical driver 184, it should be understood that such interaction can be applied to any support, biaser, and driver, including the lateral support 152, lateral biaser 156 and lateral driver 232 described below.

Returning to FIG. 17, the male dovetail-shaped portion 76 of the bow engager 32 slidably engages the female dovetail-shaped portion 120 of the vertical adjuster 108, and the pitch of the threaded shaft 188 produces movement of the vertical adjuster 108 along the vertical axis 68. The vertical driver 184 produces incremental movement of the vertical adjuster 108 along the vertical axis 68. In one example, one full revolution of the vertical driver 184 results in a movement of the vertical adjuster 108, $1/32^{nd}$ of an inch along the vertical axis 68 (FIG. 6).

In the illustrated example, the vertical driver 184 includes a vertical adjustment grasp or knob 192 coupled to the vertical driver 184. The knob 192 facilitates manipulation of the vertical driver 184. While the vertical driver 184 is illustrated as including a knob 192, it is to be understood that other methods of rotating the vertical driver 184 are contemplated. For example, an external tool (not illustrated) can engage the vertical driver 184 to rotate the vertical driver 184. Referring back to the illustrated example, the knob 192 displays visual indicators 196 (FIG. 4) that indicate the progress through a revolution of the vertical driver 184 and, in an example, indicate in which direction the accessory 10 will be moved when the knob 192 is rotated. For example, the visual indicators 196 include hash marks, numbers, and/or letters. Furthermore, the vertical adjuster 108 and bow engager 32 can include visual indicators 200 (FIG. 4), such as a series or line of hash marks and an arrow or pointer, that indicate the magnitude of movement of the vertical adjuster 108 along the vertical axis 68. In the illustrated example, the hash lines are spaced $1/32^{nd}$ of an inch apart and indicate the position of the accessory within two-thousandths of an inch. In this example, the zero hash line is centered.

As illustrated in FIG. 17, the vertical driver 184 also includes a plurality or series of indentations or cavities 204 in a solid surface 208. For example, the plurality of cavities 204 can be positioned on the underside 208 of the adjustment knob 192. In the example shown, the cavities 204 are arranged on the perimeter of a circle with equal spaces between the cavities 204. The cavities 204 are vertical positioning cavities, which correspond to positions of the vertical adjuster 108 relative to the bow engager 32 and, ultimately to the position of the accessory 10 relative to the bow 2. For example, each cavity 204 corresponds to $1/16^{th}$ of a revolution of the vertical driver 184 or $1/512^{th}$ of an inch of movement along the vertical axis 68 (FIG. 6).

A vertical adjustment stopper 212 is configured to be at least partially inserted, in sequence, into any one of the plurality of cavities 204. In the embodiment shown, the vertical adjustment stopper 212 includes a spherical or dome-shaped end configured to be inserted into the cavities 204. A vertical adjustment biasing member 216 (e.g., a coil spring or other suitable spring) is configured to urge the vertical adjustment stopper 212 to be at least partially inserted into one of the plurality of cavities 204. In an embodiment, the vertical adjustment stopper 212 includes a ball or spherical object. Biasing the adjustment stopper 212 to be partially inserted into one of the cavities 204 enables the adjustment stopper 212 to act as an initial position stopper to hold the positioning of the vertical driver 184. As the user turns the knob 184, the end of the vertical adjustment stopper 212 sequentially pops in and out of the cavities 204 until the user stops rotating the knob 184. At that point, the vertical adjustment stopper 212 settles in one of the cavities 204. This stopping or landing location establishes a stopping location that definitively corresponds to one of the visual indicators 196, 200. This provides the user with an advantage of greater precision and certainty in making the vertical adjustment.

Together, the plurality of cavities 204, vertical adjustment stopper 212, and vertical adjustment biasing member 216 act as a feedback of the positioning of the accessory 10 within the adjustment range. For example, the feedback can be tactile output and/or audible output. In an example, movement of the adjustment stopper 212 between cavities 204 produces a series of "click" sounds that are audible to the user. In one example, each "click" equates to an incremental movement or adjustment of the positioning of the accessory 10. For example, the positioning of the accessory 10 can be adjusted by $1/512^{th}$ of an inch per "click", or each "click" is $1/16^{th}$ of a revolution of the vertical driver 184.

Referring to FIGS. 10 and 20-23, in the illustrated embodiment, a cavity 220 extends at least partially through the bow engager 32 along the lateral axis 64. For example, the cavity 220 extends through the second portion 84 of the male dovetail-shaped portion 76. A vertical position lock 224 is positioned in the cavity 220 and configured to maintain the vertical adjuster 108 in a desired vertical position along the vertical axis 68. In the illustrated example, the vertical position lock 224 is a set screw. When the vertical position lock 224 is in the locked position, the vertical position lock 224 applies a force to a threaded, interior surface 228 of the first portion 80, which enlarges the slit 88 (FIG. 10). The enlargement of the slit 88 causes an increase of friction between the lips 92, 96 of the male dovetail-shaped portion 76 and the lips 124, 128 of the female dovetail-shaped portion 120 (FIG. 11) of the vertical adjuster 108. This results in a securing or locking of the position of the vertical adjuster 108 relative to the bow engager 32. In operation, first the user turns the knob 184 and stops at a desired stopping location based on the vertical adjustment stopper 212. To more securely fix the vertical position for shooting or transport of the bow 2, the user then screws or rotates the vertical position lock 224 using a tool, such as a wrench or screw driver.

Figure 15:
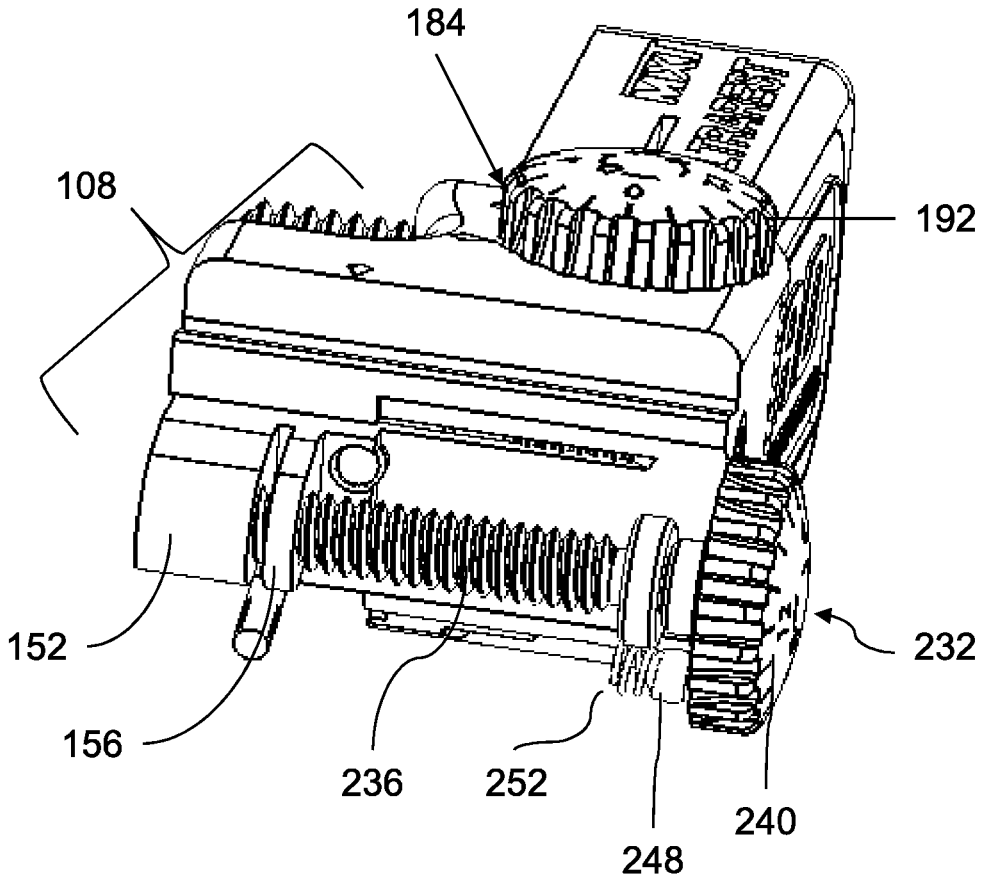
FIG. 15 is a rear isometric, partial cutaway view of the bow accessory mounting system of FIG. 3.
Figure 16:
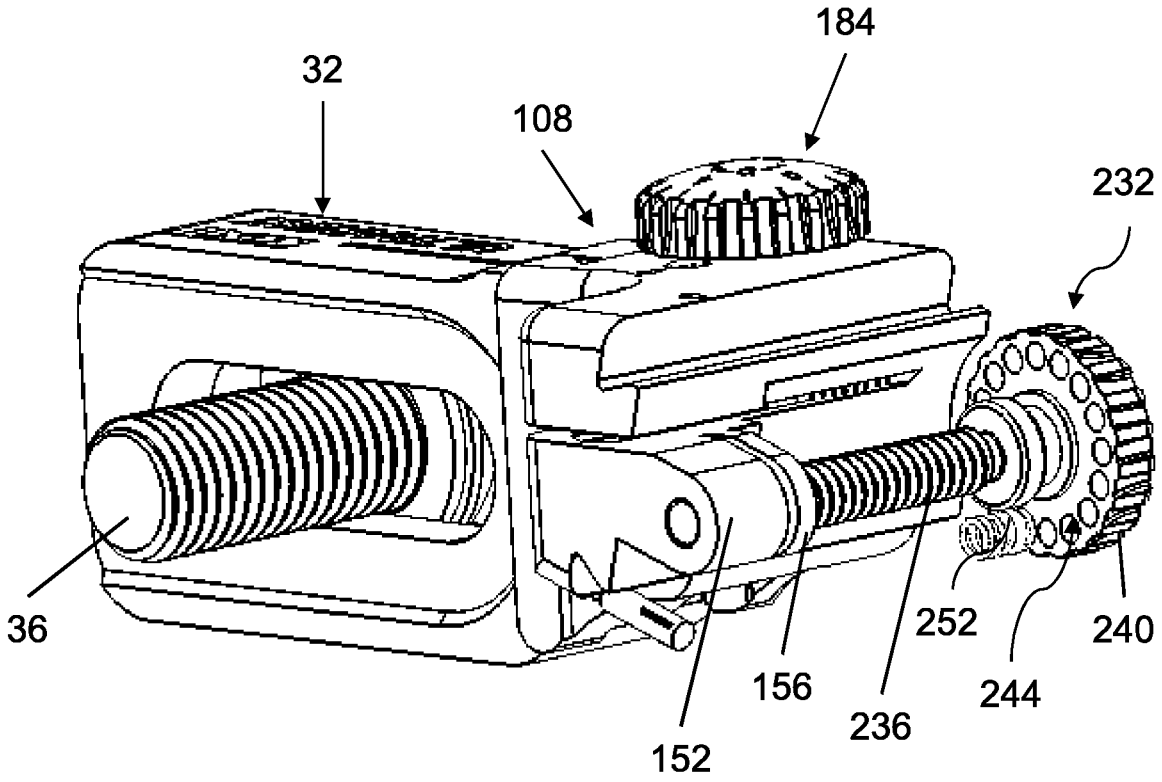
FIG. 16 is side isometric, partial cutaway view of the bow accessory mounting system of FIG. 3.

Referring back to FIGS. 4-9, as well as FIGS. 15-16, a lateral driver 232 is positioned in the adjusters 108, 112. Similar to the vertical driver 184, the lateral driver 232 has a threaded shaft 236 that rotatably engages the lateral support 152 and the lateral biaser 156. In an embodiment, the lateral biaser 156 has the same structure, configuration and elements as the vertical biaser 104. In operation, however, the lateral biaser 156 is a leaf spring or biasing member that is predisposed to generate an axial lateral force acting along the lateral axis 64 (FIG. 6) to push the threads of the lateral driver 232 against the threads of the lateral support 152 to reduce or eliminate gaps between such cooperating threads, as described in FIGS. 18-19 with regard to the vertical biaser 184.

In an embodiment, the lateral support 152, lateral biaser 156 and lateral driver 232 (FIGS. 15-16) have the same elements, structure, force effects, results and functionality as the vertical support 100, vertical biaser 104, and vertical driver 184 (FIG. 19) except that: (a) the lateral support 152, lateral biaser 156 and lateral driver 232 are oriented to extend laterally along the lateral axis 64 (FIG. 6); and (b) the vertical force 376 is replaced with a lateral force generated by the lateral biaser 156.

The male dovetail-shaped portion 140 (FIG. 12) of the vertical adjuster 108 slidably engages the female dovetail-shaped portion 164 (FIG. 13) of the lateral adjuster 112. As illustrated in FIG. 6, the rotation of the lateral driver 232 produces movement of the lateral adjuster 112 relative to the vertical adjuster 108 along the lateral axis 64. The lateral driver 184 acts as described above with regard to the vertical driver 184 except that the lateral driver 184 generates incremental, lateral movement of the accessory 10 relative to the bow 2. As described above with respect to the vertical driver 184, visual indicators 196, 200 on the lateral adjustment grasp or knob 240 and/or adjusters 108, 112 provide visual indication of the lateral position of the lateral adjuster 112.

As described above with respect to the vertical driver 184, and particularly illustrated by FIGS. 15-16, the lateral driver 232 includes a plurality or series of indentations or cavities 244, a lateral adjustment stopper 248 configured to be at least partially inserted into any one of the cavities 244, and a lateral adjustment biasing member 252 configured to urge the lateral stopper 248 into the cavities 244. The cavities 244, stopper 248, and biasing member 252 act together to provide feedback as to the position of the lateral adjuster 112 and to maintain the lateral driver 232 in a desired stopping position. In an embodiment, the lateral driver 232 has the same structure, components and configuration as the vertical driver 184. In operation, however, the lateral driver 232 causes controlled, incremental movement along the lateral axis 64 as opposed to the controlled, incremental movement along the vertical axis 68 caused by the vertical driver 184.

As illustrated by FIG. 12, a cavity 256 extends at least partially through the vertical adjuster 108 along the lateral axis 64. As described above, the lateral slit 145 extends partially into the vertical adjuster 108 from the rear surface 136 into the vertical adjuster 108 and from the side surface 143 into the vertical adjuster 108, bisecting or transecting the cavity 256. As illustrated by FIGS. 20-23, a lateral position lock 260 is positioned in the cavity 256. The lateral position lock 260 is configured to maintain the lateral adjuster 112 in a desired lateral position along the lateral axis 64. In the illustrated embodiment, the lateral position lock 260 includes a stationary or fixed post 264 (FIG. 23) coupled to the vertical adjuster 108 and extending in the rearward direction 20 (FIG. 1). A wedge member 268 is positioned adjacent to the post 264 such that a thin portion 272 of the wedge 268 rests on the post 264 and extends along the lateral axis 64. A coupling member 280, such as a set screw, threadably engages the cavity 256 and extends along the lateral axis 64. When the position lock 260 is engaged, the coupling member 280 applies a force to the wedge member 268, which drives the thin portion 272 and the base 276 of the wedge 268 against the post 264. Due to the angled shape of the wedge 268, as the base 276 of the wedge 268 is driven into contact with the post 264, the wedge axis 269 along which wedge 268 extends, pivots or rotates relative to the lateral axis 64. Consequently, the wedge axis 269 intersects with the lateral axis 64. In the illustrated embodiment, the wedge 268 would rotate or pivot upward. The rotation of the wedge 268 brings the thin portion 272 of the wedge 268 into contact with the inner surface (not shown) of the cavity 256 in the vertical adjuster 108 and applies a force to such inner surface. The applied force causes the slit 145 to widen or expand, deforming the male dovetail-shaped portion 140 and preventing movement of or along the male dovetail-shaped portion 140, locking the lateral position of the lateral adjuster 112. In operation, first the user turns the knob 232 and stops at a desired stopping location based on the lateral adjustment stopper 248. To more securely fix the lateral position for shooting or transport of the bow 2, the user then screws or rotates the lateral position lock 260 using a tool, such as a wrench or screw driver.

FIGS. 24-32C illustrate another embodiment of a locking system 380 for a bow accessory mounting system 370. The locking system 380 includes a locking member 382. In the illustrated embodiment, the locking member 382 has an elongated body 383 with a first end 381 and a second end 385. The body 383 has a first threaded section 384 and a second threaded section 386. As illustrated by FIGS. 25A-25C, the first threaded section 384 has a first diameter 388 and the second threaded section 386 has a second diameter 390, with the first diameter 388 being larger than the second diameter 390. The first threaded section 384 has a first threaded surface 392 and the second threaded section 386 has a second threaded surface 394. In an embodiment, the first threaded surface 392 has a 10-32 UNF left-hand thread, and the second threaded surface 394 has a 6-32 UNC right-hand thread. The first end 381 defines an opening 387 extending partially into the body 383. In an embodiment, the opening 387 is shaped to receive and engage with a tool (not shown) for turning or rotating the body 383.

Figure 26A:
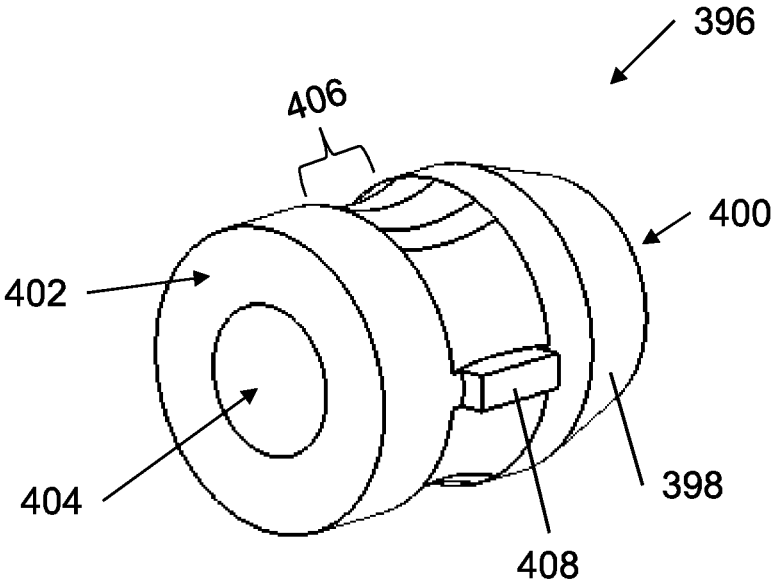
FIG. 26A is a side isometric view of an embodiment of a locking nut of the bow accessory mounting system of FIG. 3.
Figure 26B:
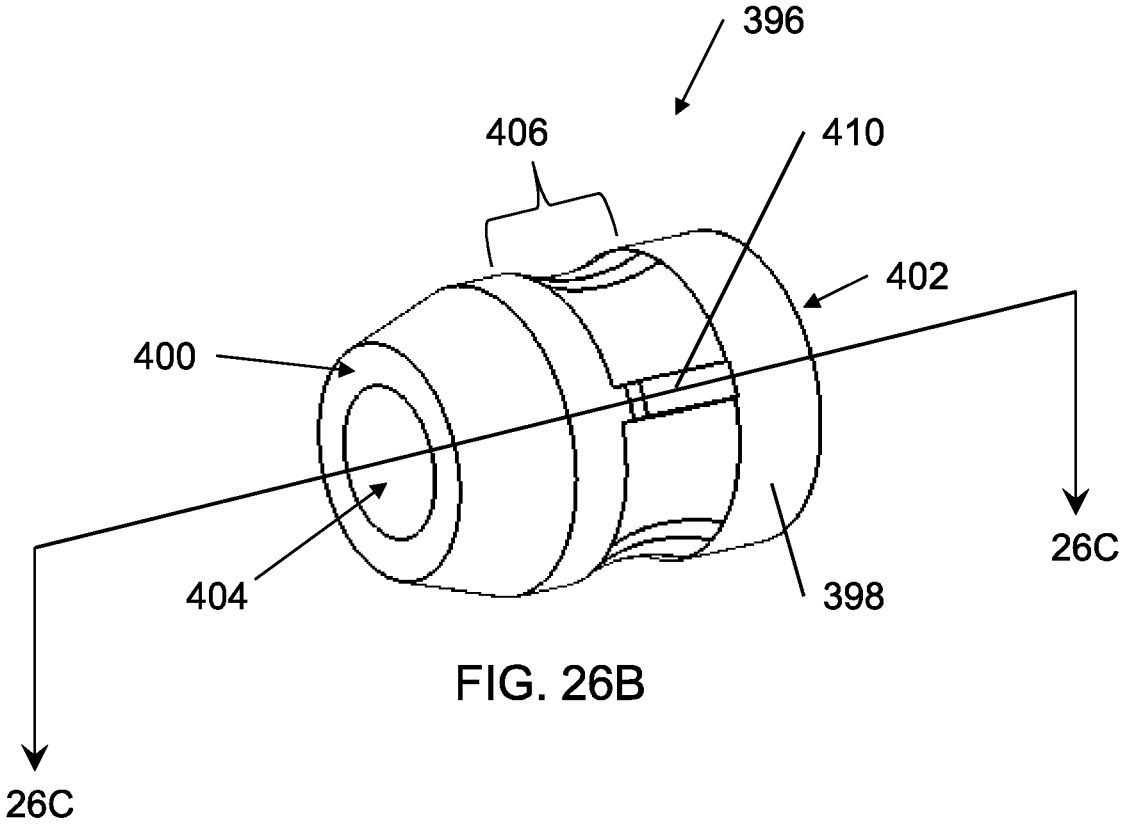
FIG. 26B is another side isometric view of the locking nut of FIG. 26A.
Figure 26C:
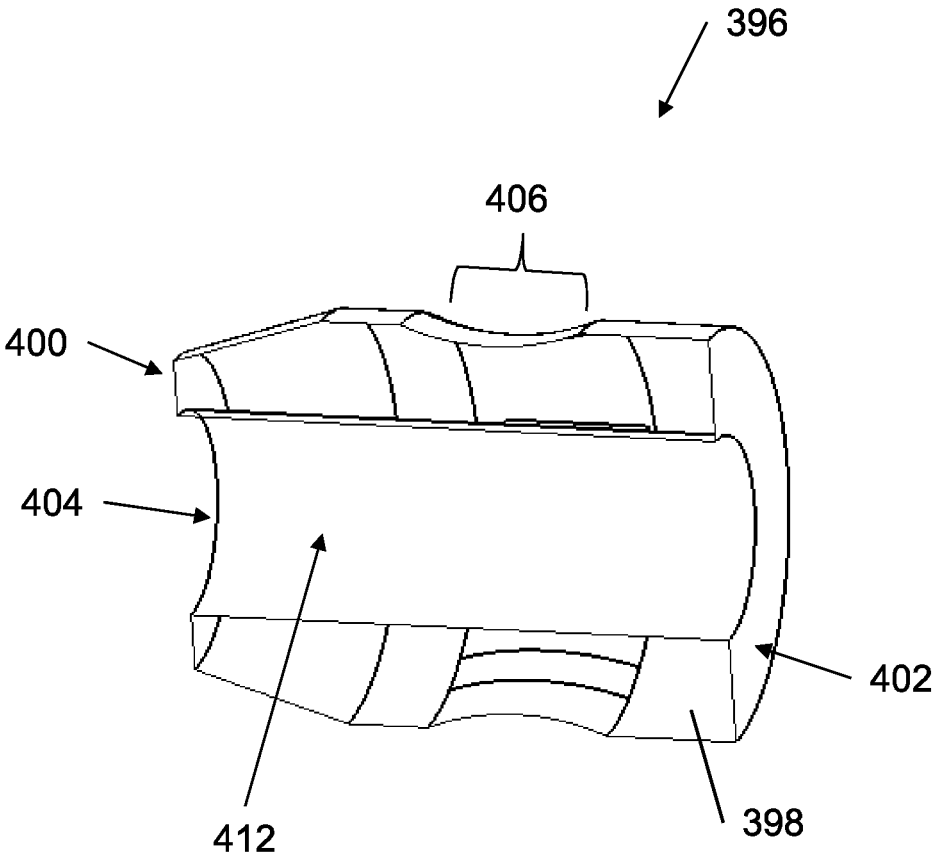
FIG. 26C is a cross-sectional view of the locking nut of FIG. 26A, taken substantially along line 26C-26C of FIG. 26B.

The locking system 380 also includes a nut member 396. As illustrated by FIGS. 26A-26C, the nut member 396 has a body 398 with a first end 400 and a second end 402. The body 398 has a generally cylindrical or tubular shape, tapering at the first end 400, with a concave middle section 406 extending around the circumference of the body 398. An aperture or opening 404 extends through the body 398 from the first end 400 to the second end 402. The interior surface 412 of the aperture 404 is threaded (not shown) to engaged with the second threaded surface 394 of the locking member 382. A first tab 408 and a second tab 410 extend or protrude outward from the middle section 406.

Figure 27:
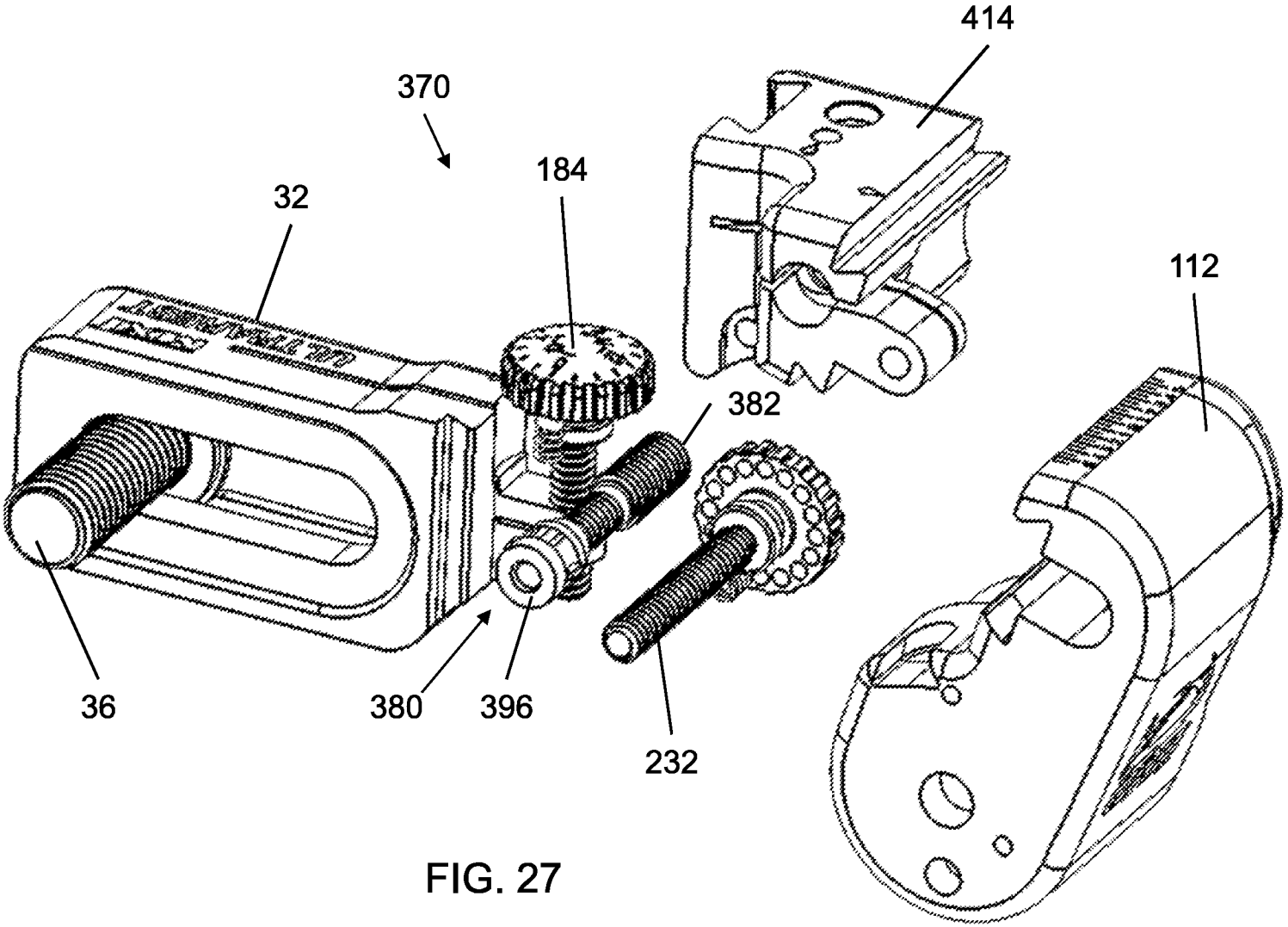
FIG. 27 is an exploded view of the bow accessory mounting system of FIG. 3, illustrating the locking system of FIG. 24.

As illustrated by FIG. 27, similar to the bow accessory mounting system 12 described above, the bow accessory mounting system 370 includes a bow engager 32 having a vertical driver 184 and a coupler 36 and a lateral adjuster 112 with a lateral driver 232. The bow accessory mounting system 370 also includes a vertical adjuster 414 that receives the locking system 380, which includes the locking member 382 and the nut member 396.

Figure 28A:
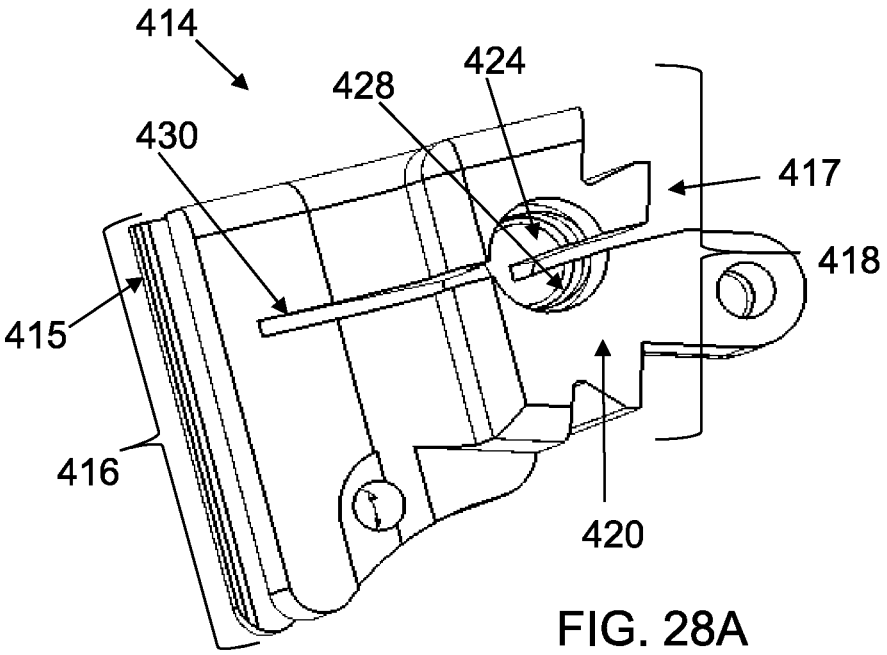
FIG. 28A is a side isometric view of an embodiment of a vertical adjuster of the bow accessory mounting system of FIG. 27.
Figure 28B:
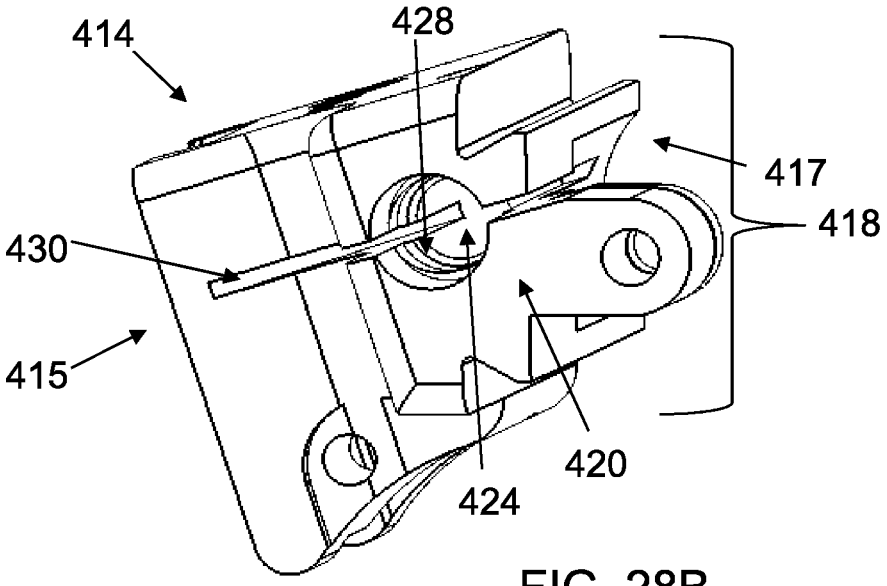
FIG. 28B is another side isometric view of the vertical adjuster of FIG. 27.
Figure 28C:
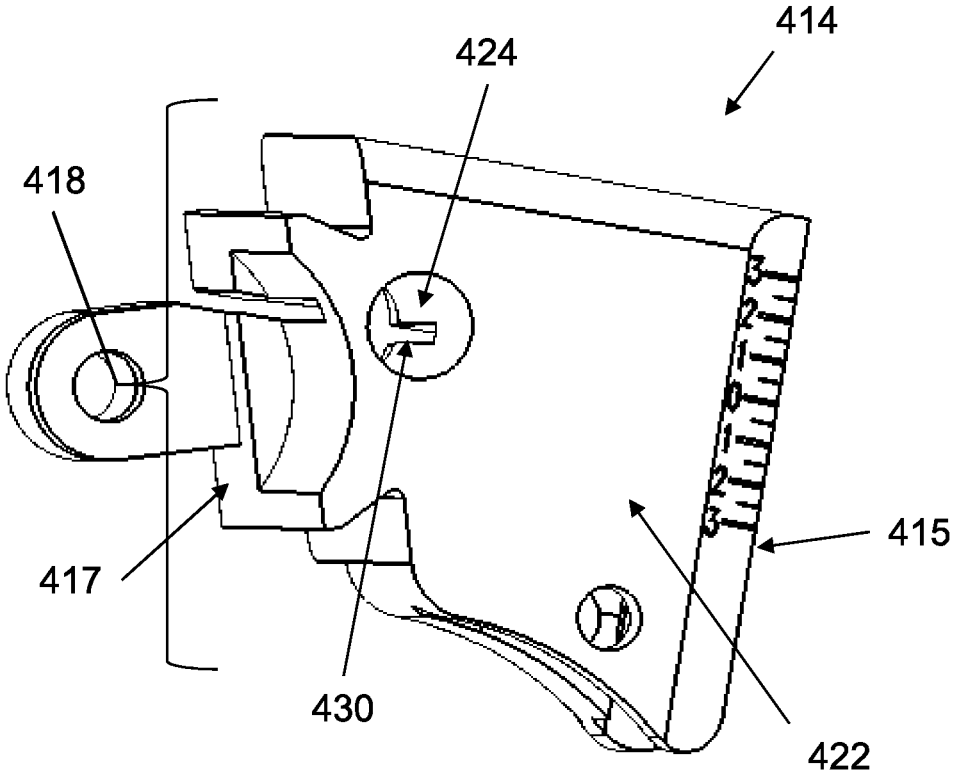
FIG. 28C is a top isometric view of the vertical adjuster of FIG. 27.
Figure 29:
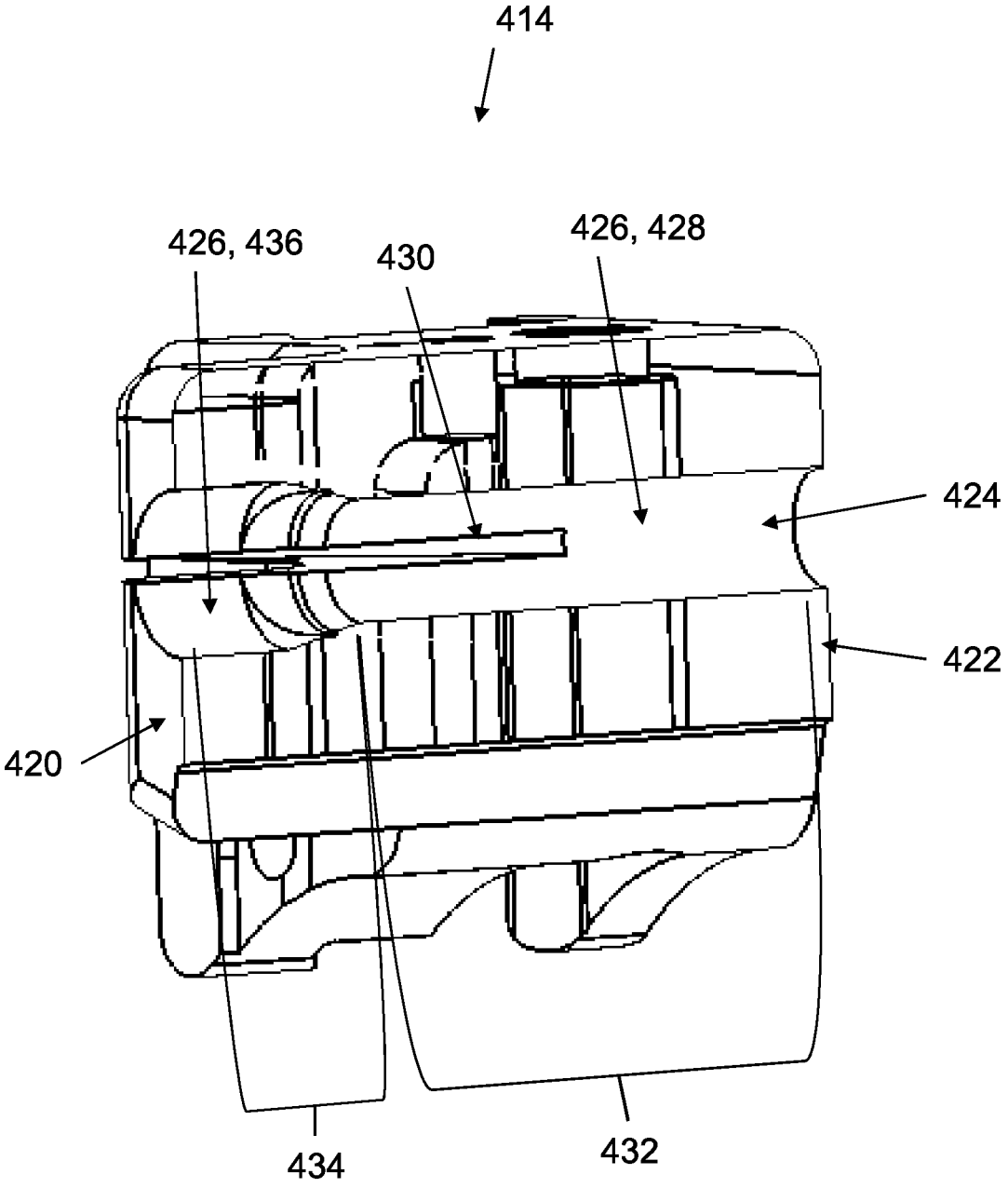
FIG. 29 is a rear perspective cross-sectional view of the vertical adjuster of FIG. 27.

With reference to FIGS. 28A-29, the vertical adjuster 414 has a body 413 with a front surface 415, a rear surface 415, a first side surface 420, and a second side surface 422. The front surface 415 has a female dovetail-shaped portion 416, and the rear surface 417 has a male dovetail-shaped portion 418. An opening or aperture 424 extends through the body 413 from the first side surface 420 to the second side surface 422. A portion 432 of the interior surface 426 of the aperture 424 is a threaded surface 428, and a second portion 434 of the interior surface 426, leading to the threaded surface 428, is angled or tapered to form a ramp portion 436. A slit 430 extends, horizontally, partially through the body 413, from the first side surface 420 partially into the body 413 toward the second side surface 422 and from the rear surface 417 partially into the body 413 toward the front surface 415, transecting or bisecting the aperture 424.

Figure 30:
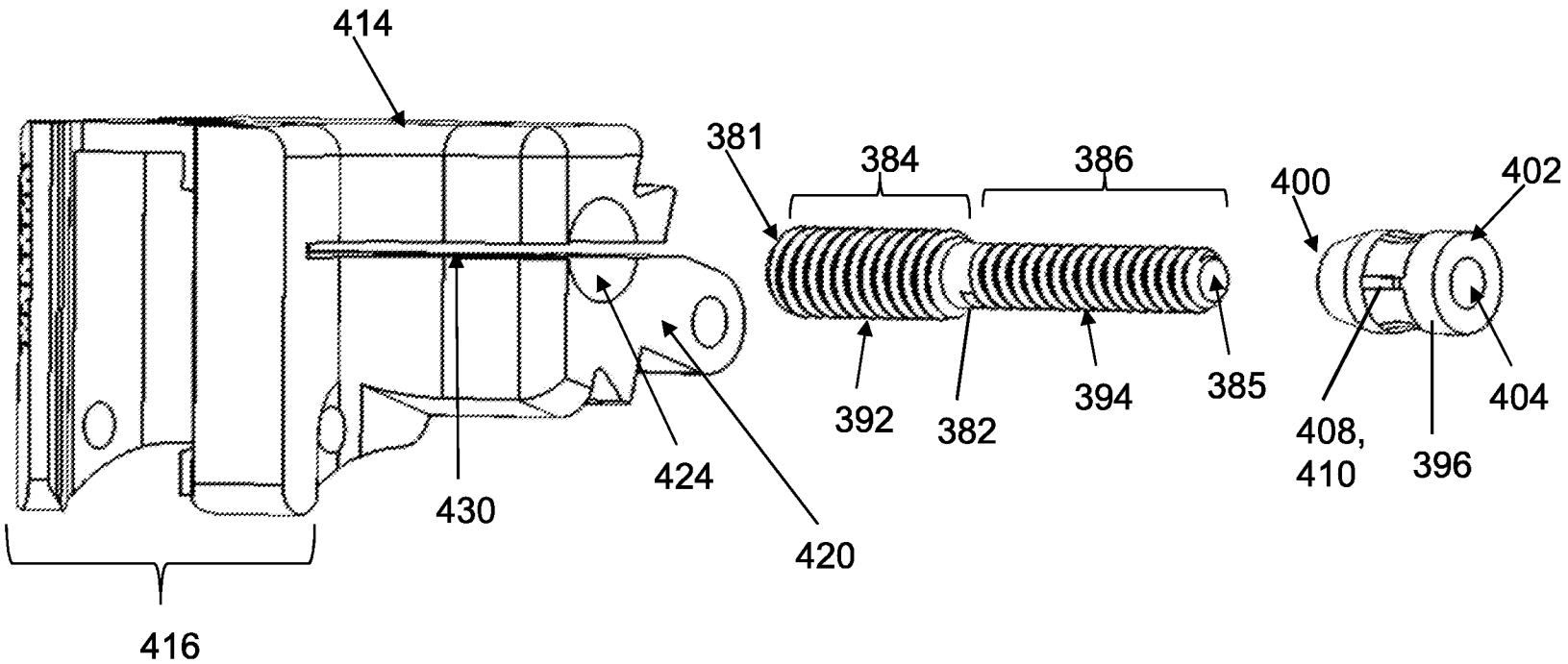
FIG. 30 is an exploded front isometric view of the vertical adjuster of FIG. 27 and a locking member.
Figure 31:
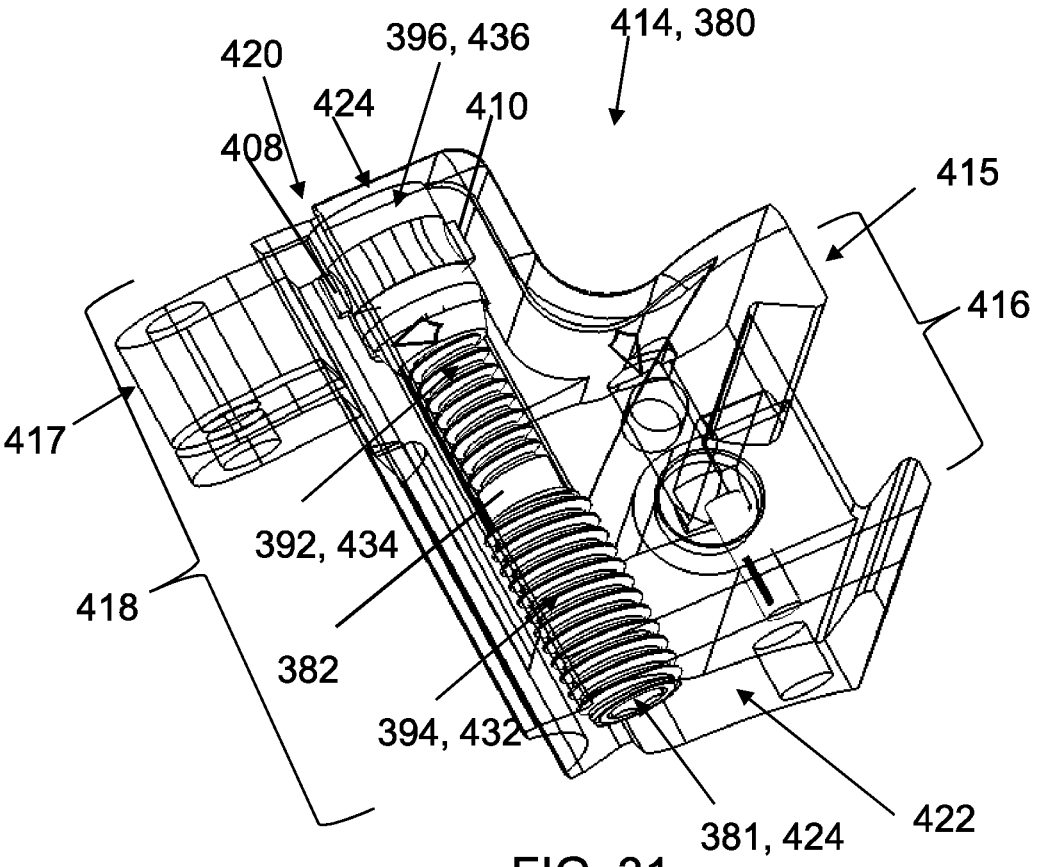
FIG. 31 is a top isometric view of the vertical adjuster of FIG. 27 with a locking member retained within.
Figure 32:
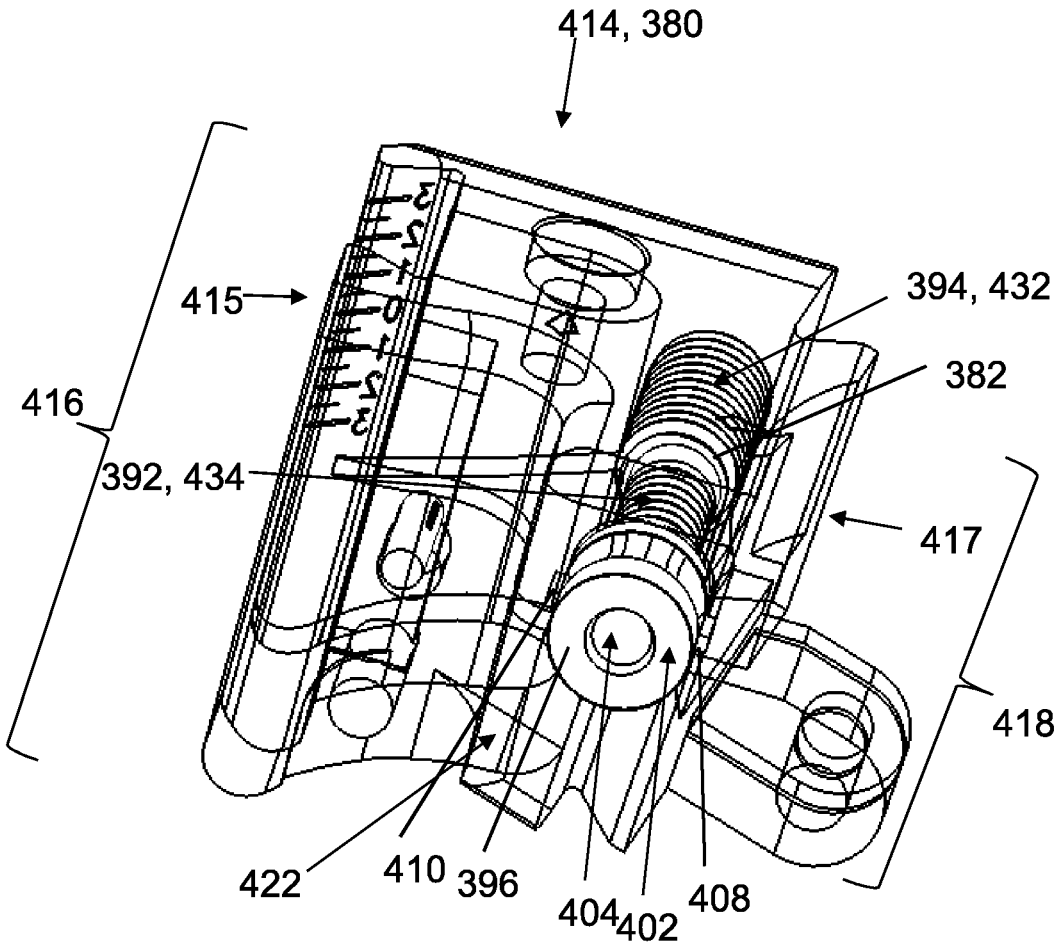
FIG. 32 is a side isometric view of the vertical adjuster of FIG. 31 with the locking member retained within.
Figure 33:
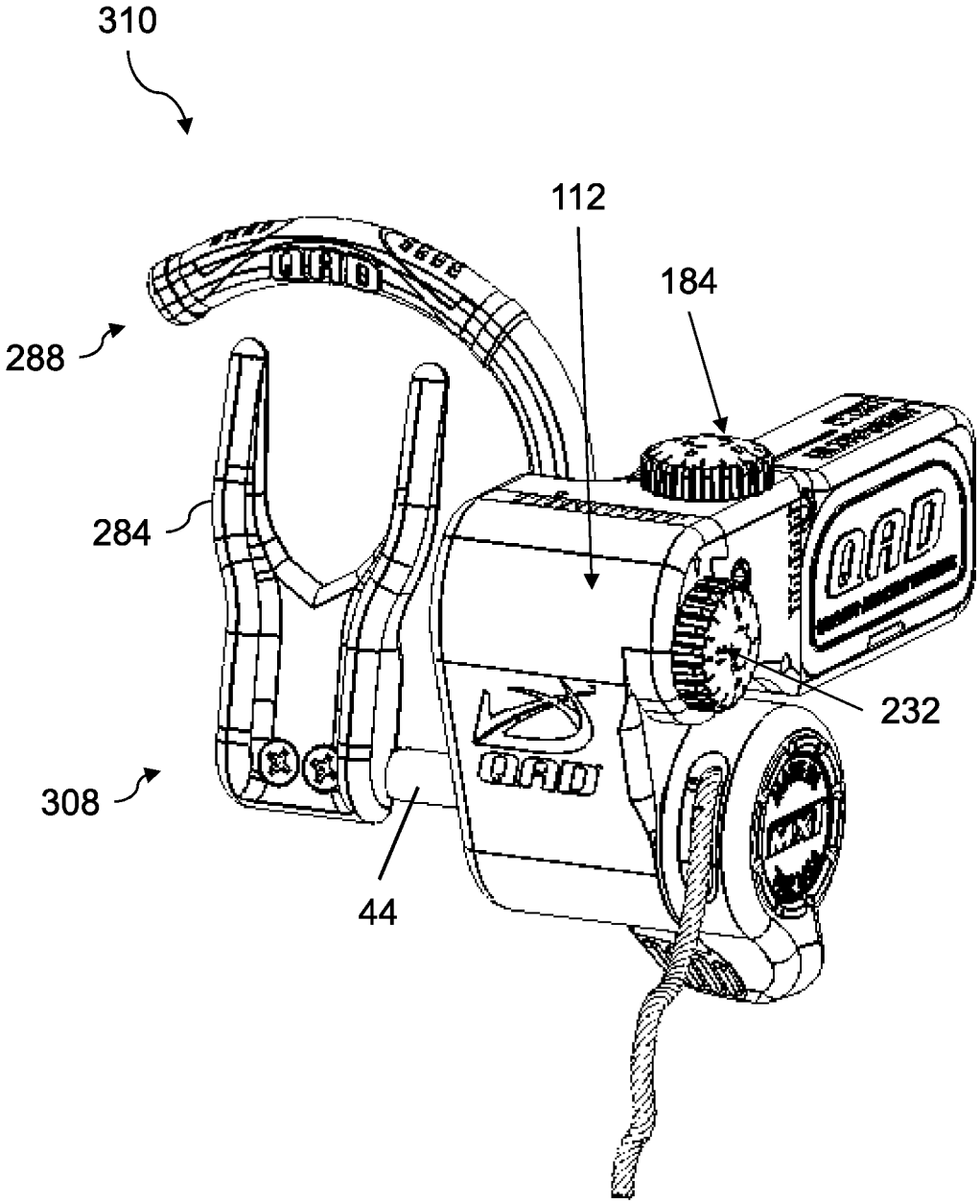
FIG. 33 is a rear isometric view of an embodiment of a bow accessory mounting system with an attached arrow rest assembly.
Figure 34:
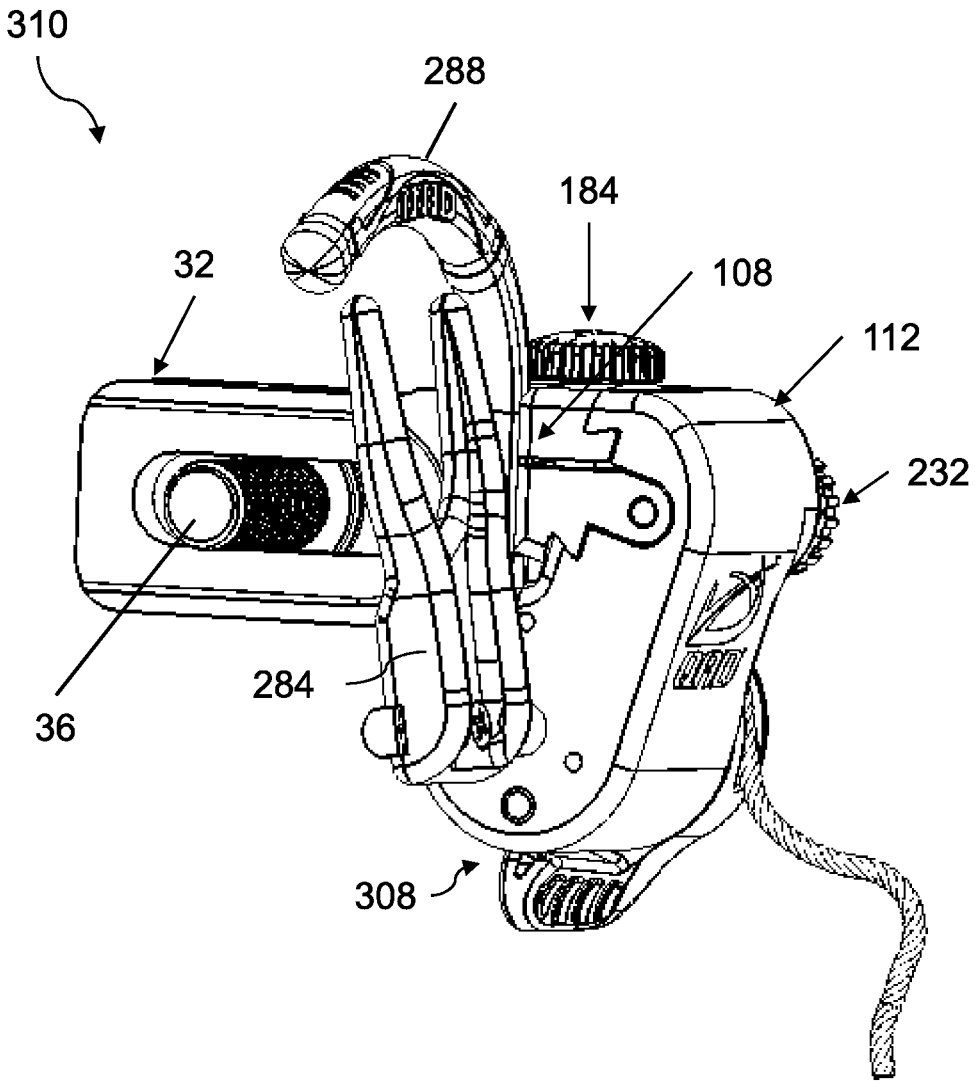
FIG. 34 is a side isometric view of the bow accessory mounting system of FIG. 33.
Figure 35:
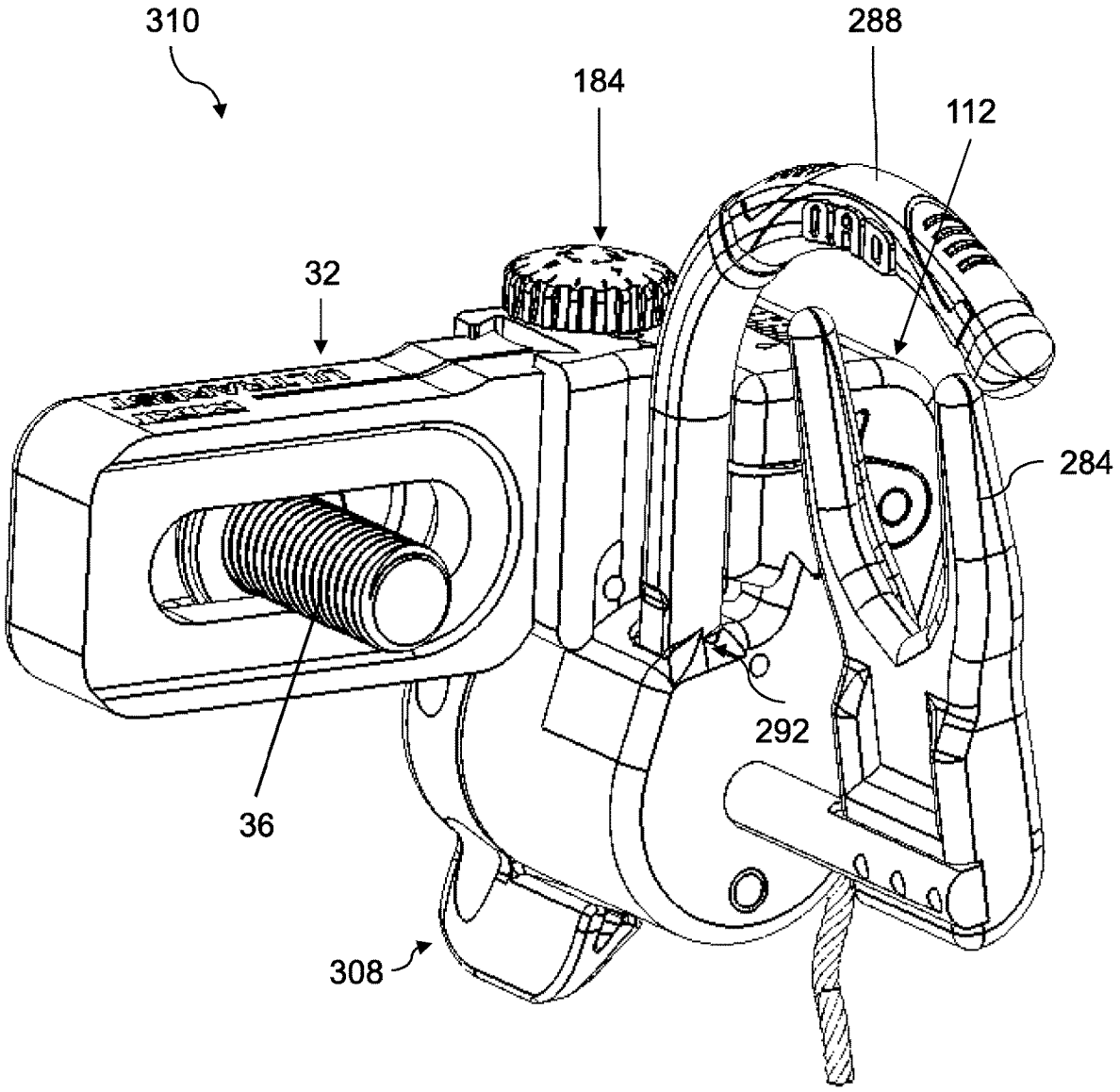
FIG. 35 is another side isometric view of the bow accessory mounting system of FIG. 33.
Figure 36:
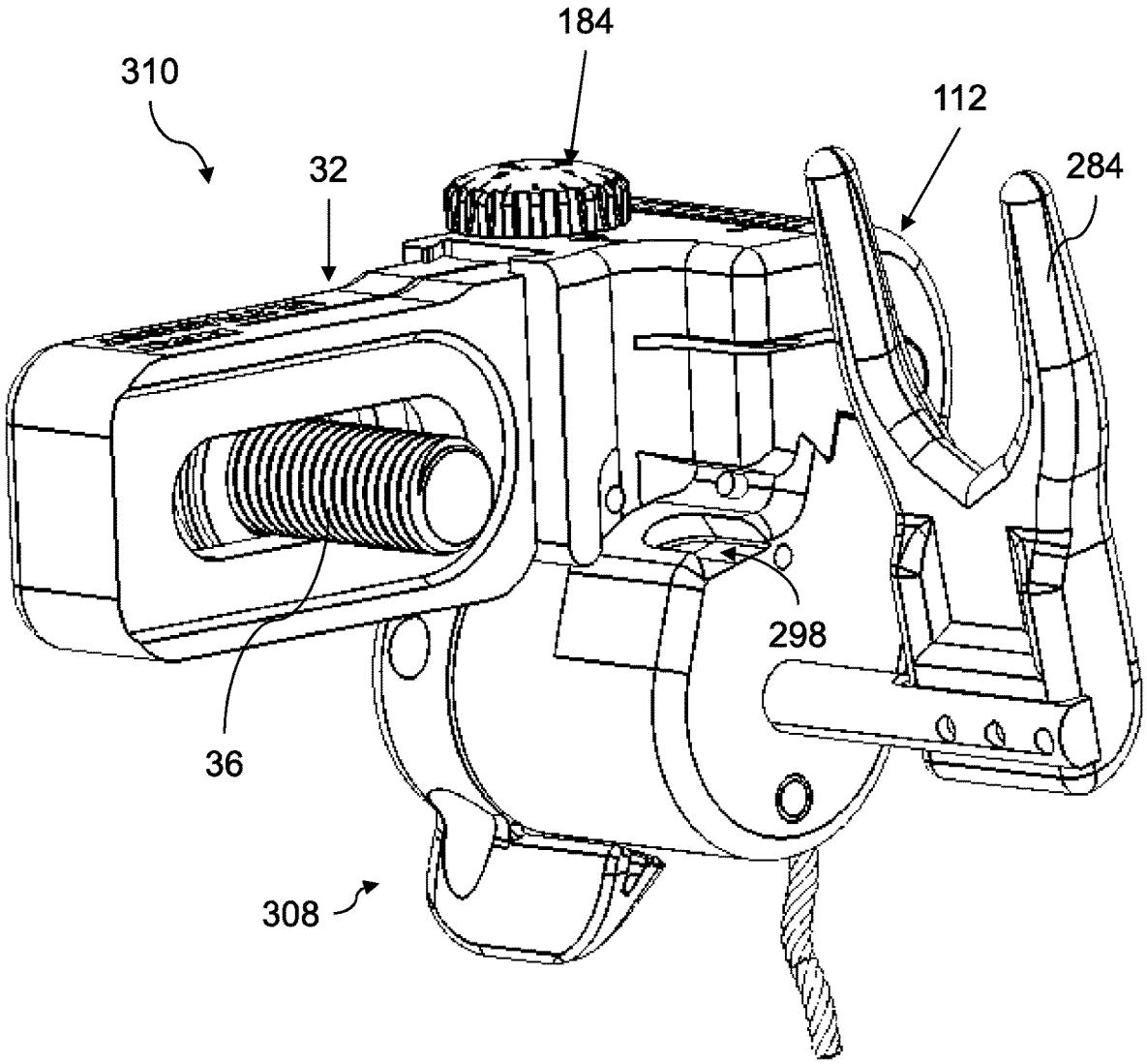
FIG. 36 is a front isometric view of the bow accessory mounting system of FIG. 33.
Figure 37:
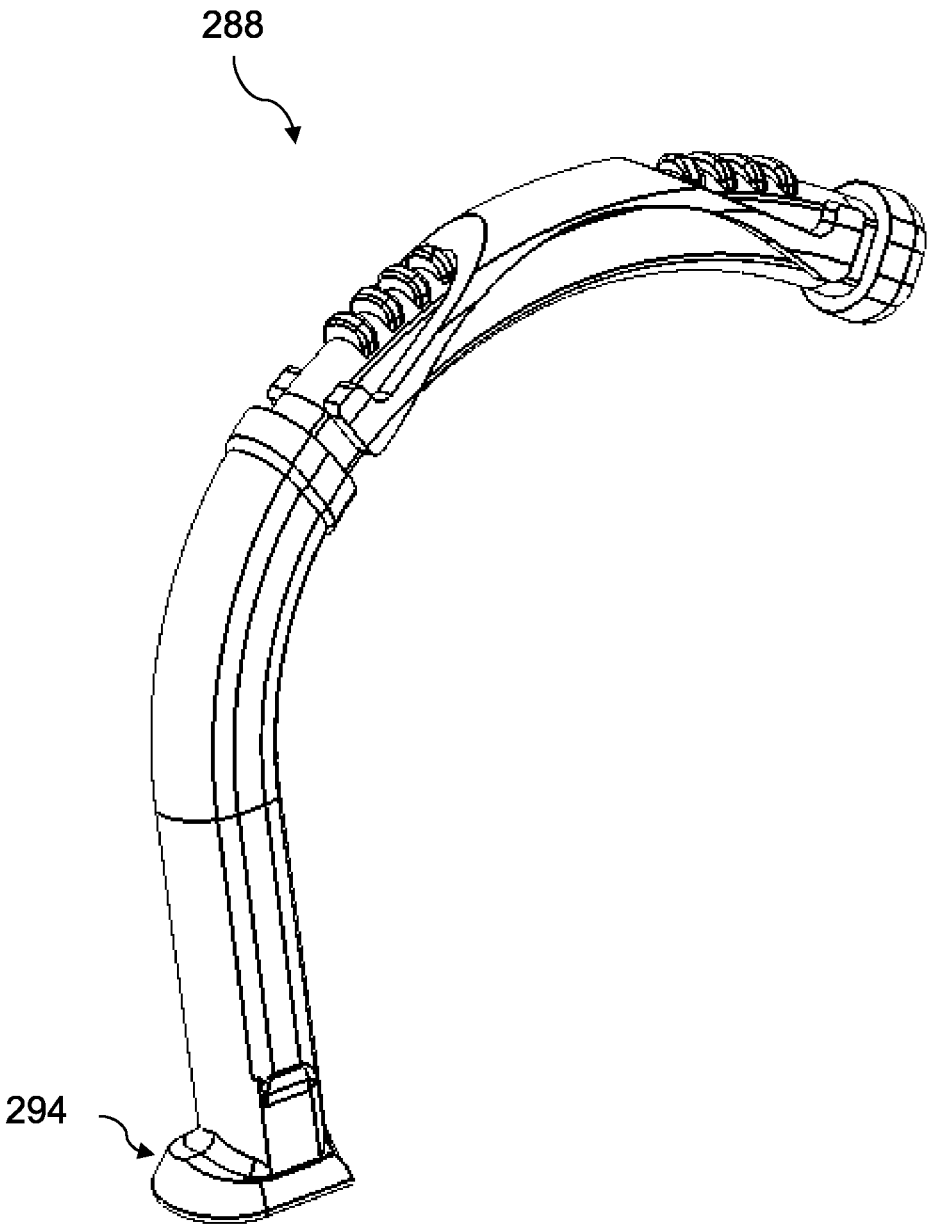
FIG. 37 is a rear isometric view of an embodiment of a capture bar of an arrow rest assembly of the bow accessory mounting system of FIG. 33.

As illustrated by FIGS. 30-32, the first threaded section 384 of the locking member 382 is inserted in the aperture 424 such that the first threaded surface 392 engages with the threaded surface 428 of the aperture 424 and the second threaded section 386 extends into the ramp portion 436 of the aperture 424. The nut member 396 is threaded onto the second threaded section 386 so that the threaded interior surface 412 engages the second threaded surface 394. The nut member 396 is drawn into the ramp portion 436 of the aperture with the first tab 408 and second tab 410 extending into the slit 430 to prevent rotation of the nut member 396. As the user rotates the locking member 382, the nut member 396 is drawn into the aperture 424, causing the slit 430 to expand and prevent movement of or along the male dovetail portion 418. The first threaded section 384 and second threaded section 386 cooperate to define a stop portion to prevent overtightening of the locking member 382 and nut member 396. In an embodiment, the locking member 382 can be rotated clockwise to lock the position of male dovetail portion 418, and the locking member 382 can be rotated counterclockwise to allow adjustment of the male dovetail portion 418.

With particular reference to FIGS. 6, 13-14 and 38-39C, the lateral adjuster 112 has a first side surface 450*a* (FIGS. 6 and 13) and a second side surface 450*b*. A channel or cavity 452, having a generally U-shaped profile, extends laterally through the lateral adjuster 112 from the second side surface 450*b* to the first side surface 450*a*. The channel 452 is open at the second side surface 450*b* and at the rear surface 451 of the lateral adjuster 112, and the channel 452 is closed by the first side surface 450*a*. The second side surface 450*a* has a driver support or lip surface 454 overlapping the channel 452 to define an opening or aperture 456 extending through the first side surface 450*a* into the channel 452.

Figure 38:
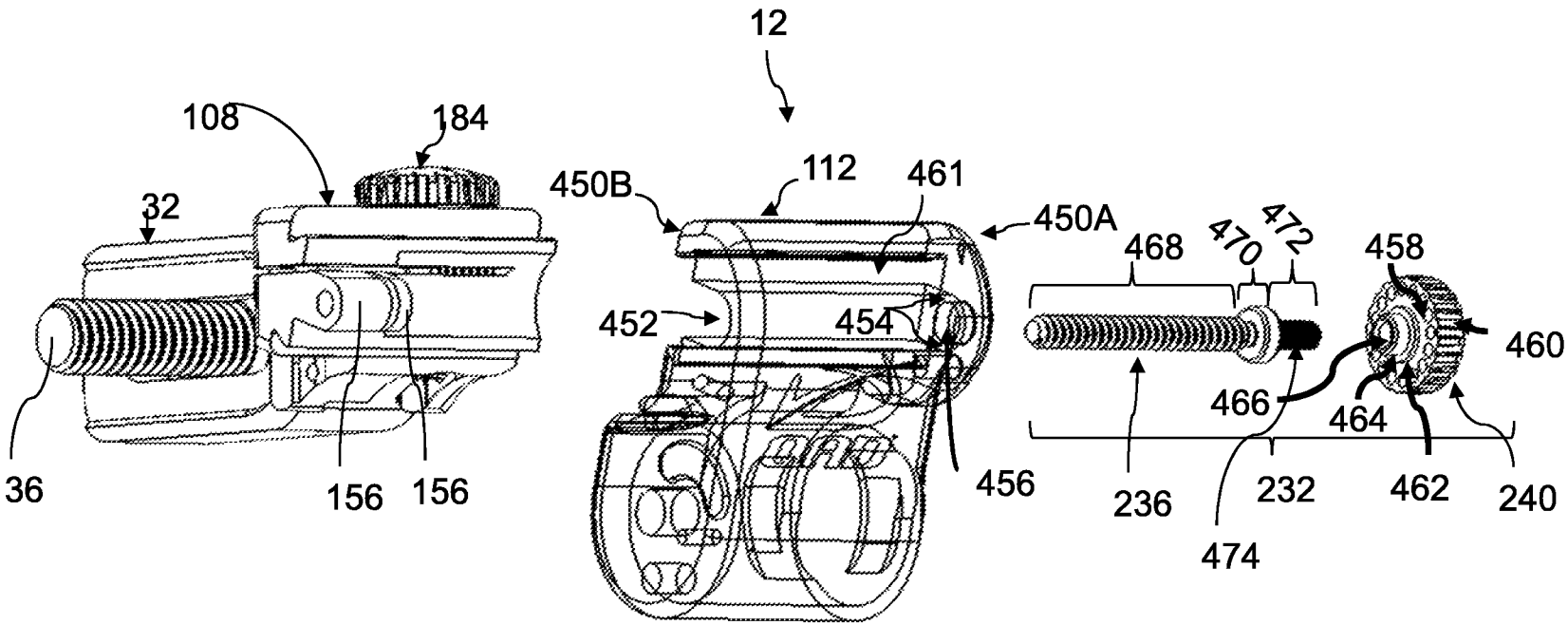
FIG. 38 is a partially exploded rear isometric view of the bow accessory mounting system of FIG. 3.

As previously described, the lateral driver 232 has a threaded shaft 236 and a knob 240 as illustrated in FIG. 38. The knob 240 has a rear surface 458 and a grip surface 460 having a plurality of ridges. Extending from the rear surface 458 is a first shoulder or protrusion 462 and a second shoulder or protrusion 464, concentric with and extending from the first shoulder 462, resulting in a step-shaped profile. In the embodiment shown, each protrusion 462, 464 is circular, ring-shaped or tubular. It is to be understood the that first protrusion 462 and the second protrusion 464 can have different heights and different diameters. A channel or cavity 466 extends into and through the protrusions 462, 464 to the rear surface 458.

The threaded shaft 236 has a threaded portion 468, a shoulder portion 470 adjacent to the threaded portion 468, and an engagement portion 472 adjacent to the shoulder portion 470, opposite the threaded portion 468. The engagement portion 472 has a textured surface 474. In an embodiment, the engagement portion 472 is constructed of metal, and the textured surface 474 has a knurled surface.

When the bow mounting system 12 is assembled, the female dovetail-shaped portion 164 of the lateral adjuster 112 engages the male dovetail-shaped portion 140 of the vertical adjuster 108 and the lateral support 152 and lateral biaser 156 are positioned within the channel 452. The threaded portion 468 of the threaded shaft 236 is positioned within the channel 452 and threadably engages the lateral support 152 and the lateral biaser 156. The shoulder portion 470 of the threaded shaft 236 is positioned within the channel 452 adjacent to the inner surface 476 (FIG. 39C) of the lip 454. The engagement portion 472 (FIG. 38) extends through the aperture 456. The cavity 466 of the knob 240 is positioned over the engagement portion 472 so that the engagement portion 472 is inserted into the cavity 466, the second protrusion 464 is inserted into the aperture 456, and the first protrusion 462 is positioned adjacent to the outer surface 478 of the lip 454. During installation, the knob 240 is first separated from the threaded shaft 236. Next, the threaded shaft 236 is inserted into the channel 452. Next, the installer attaches the knob 240 to the engagement portion 472 so that the knob 240 is exterior and adjacent to the first side surface 450*a*. The knob 240 locks to the engagement portion 472 via a press-fit or other suitable connection, such as a weld, adhesive or interlocked connection. In an embodiment, when the installer forces the knob 240 onto the engagement portion 472, the textured surface 474 of the engagement portion 472 forms grooves or cut marks on the inner surface (not shown) of the cavity 466 to fixedly secure the knob 240 to the engagement portion 472. Accordingly, in such embodiment, the knob 240 is statically connected to the engagement portion 472.

Figure 39A:
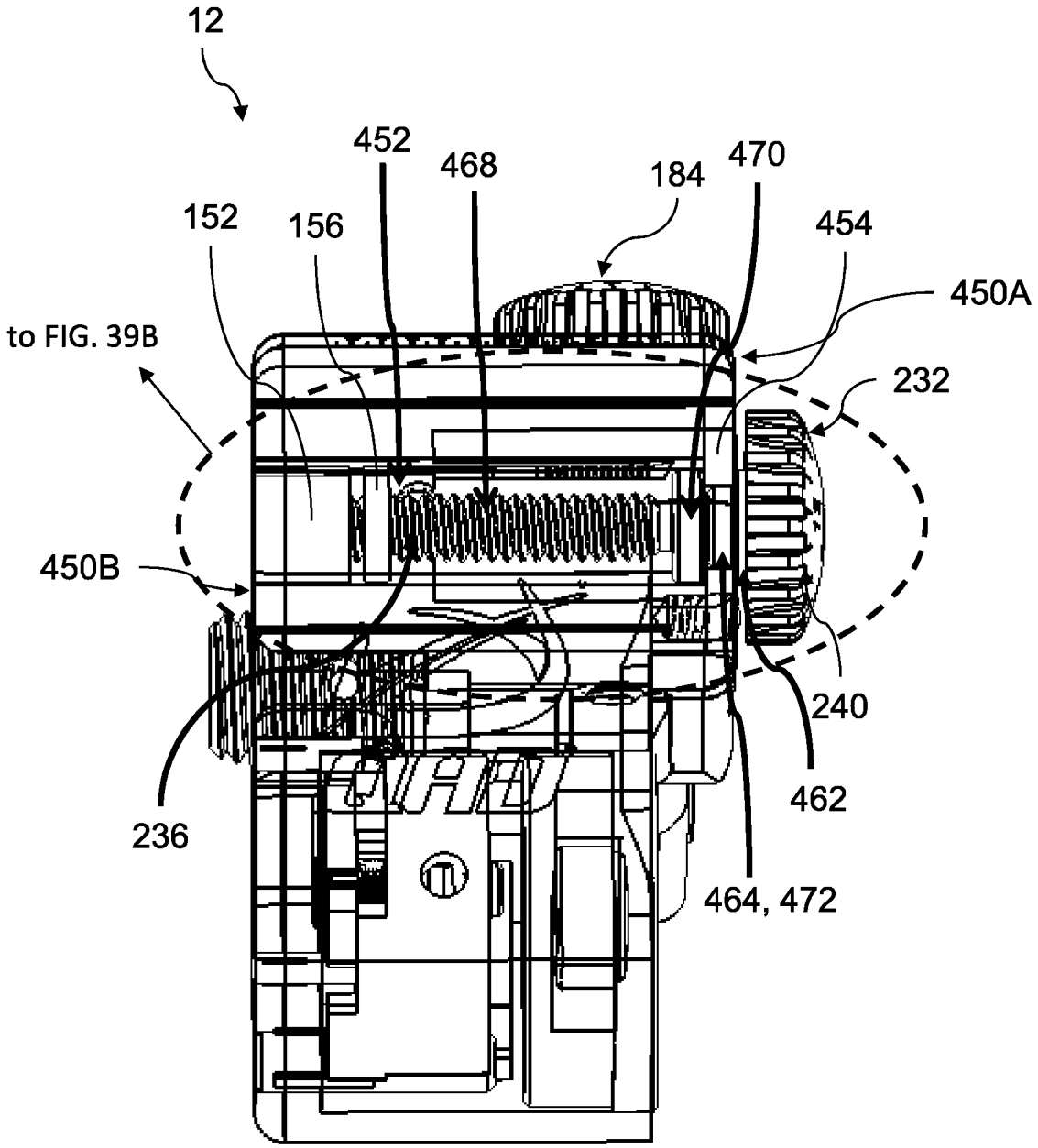
FIG. 39A is a rear isometric view of the bow accessory mounting system of FIG. 38, showing the lateral driver within the lateral adjuster 112.
Figure 39B:
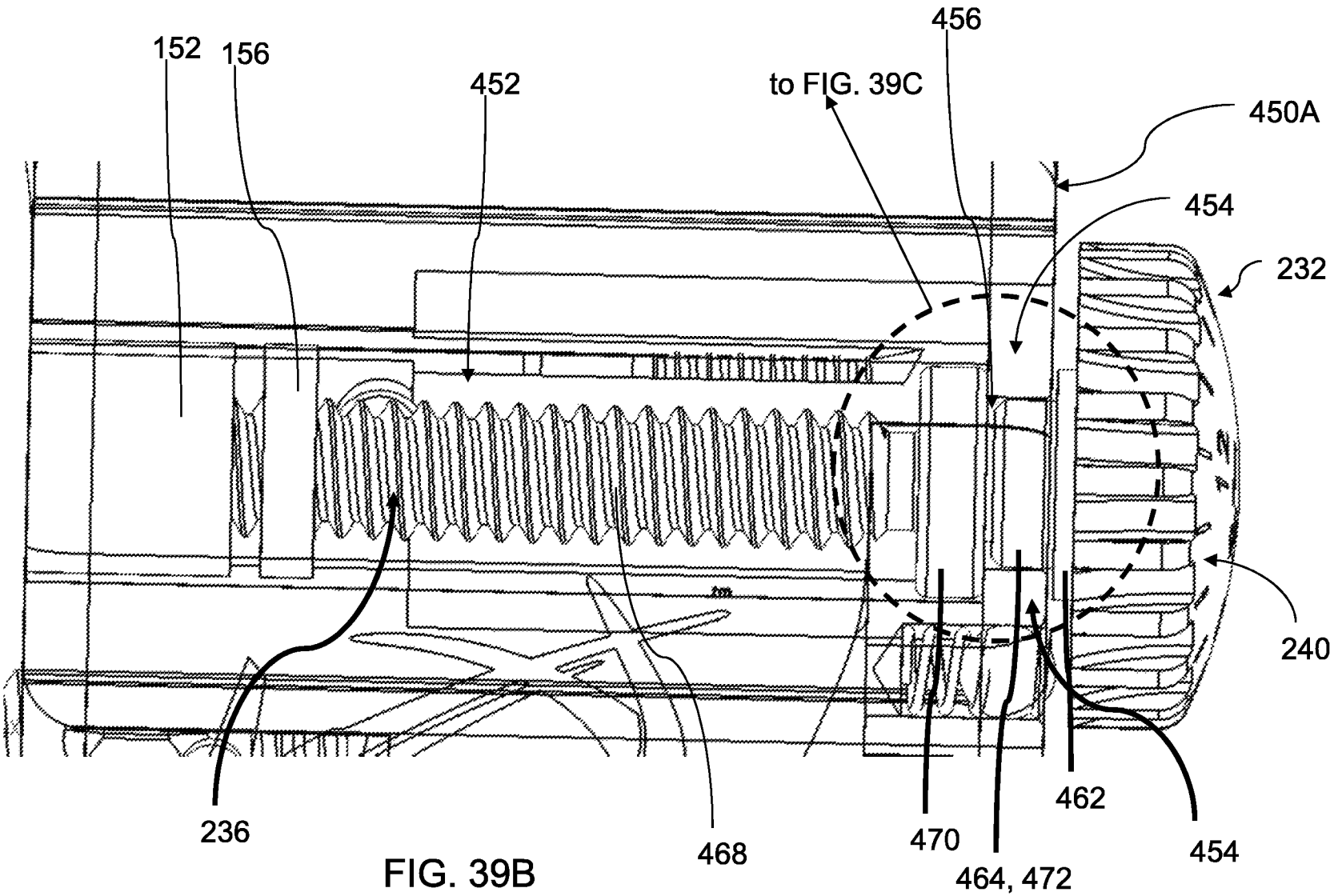
FIG. 39B is a partial enlarged view of the bow accessory mounting system of FIG. 39A.
Figure 39C:
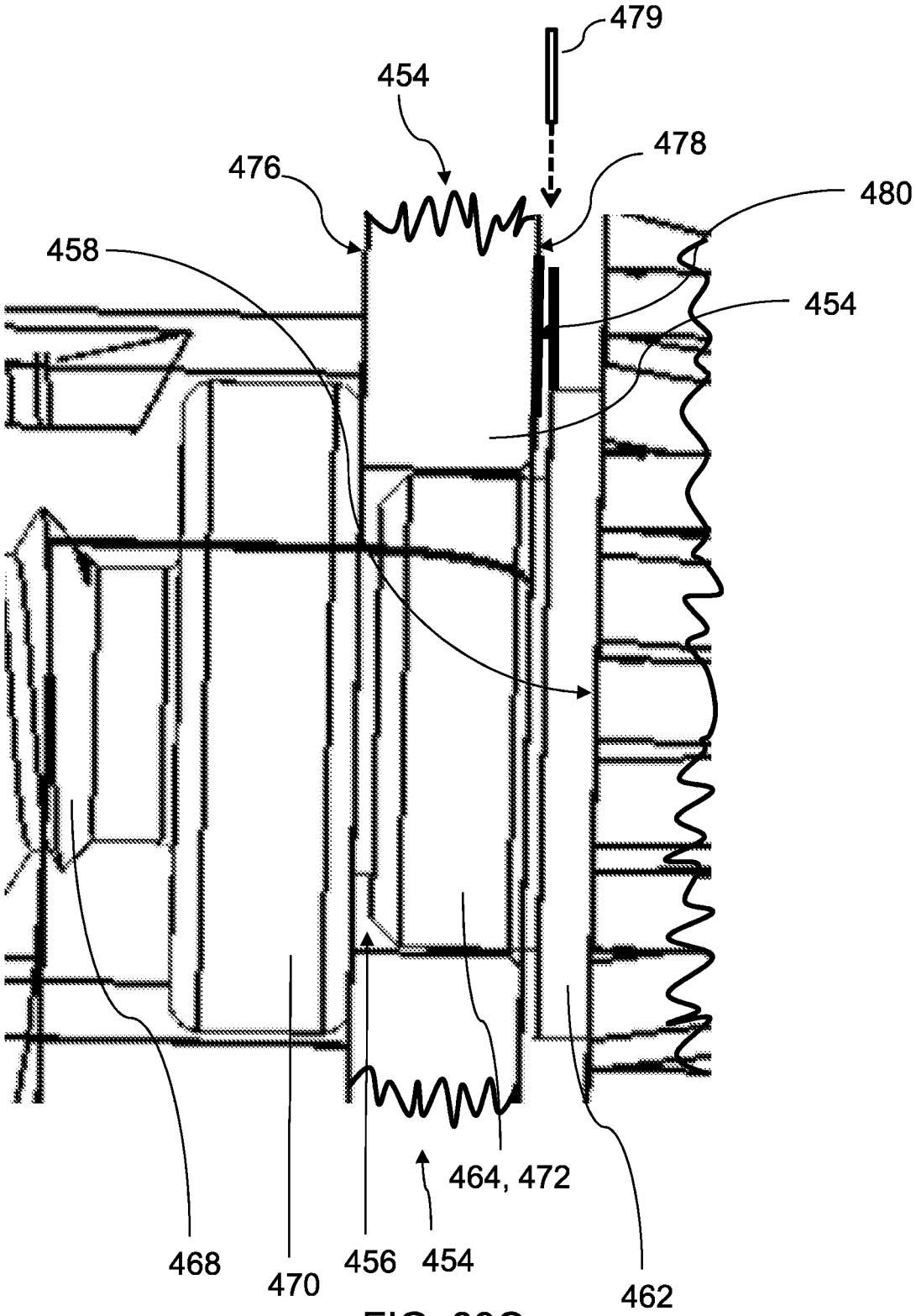
FIG. 39C is a partial enlarged view of the bow accessory mounting system of FIG. 39B.

As described above, there can be a "slop" or looseness associated with the threads of the lateral driver 232 when the lateral driver 232 is in the adjustment mode, the period before the lateral position lock 260 (FIG. 7) is tightened to lock the lateral adjuster 112. This "slop" or looseness is caused when threads do not maintain physical contact with each other. The lateral biaser 156 (FIG. 39A) eliminates such looseness or reduces the effects of such looseness, as described above. However, there can also be a secondary "slop" or looseness of the lateral driver 232 when the lateral driver 232 is in a fixed or locked mode, the period during which the lateral position lock 260 is tightened to lock the lateral adjuster 112. As described above, in the locked mode, the lateral position lock 260 is operable to widen the slit 145, deforming the male dovetail-shaped portion 140 and preventing movement of or along the male dovetail-shaped portion 140, locking the lateral position of the lateral adjuster 112. However, while the deformation of the male dovetail-shaped portion 140 prevents movement along the male dovetail-shaped portion 140, no force or securement is applied directly to the lateral driver 232 to prevent the lateral driver 232 from rotating. In addition, due to the fit between the knob 240 and the threaded shaft 236, there is a gap 480 (FIG. 39C). The gap 480 can be located between the first protrusion 462 and the outer surface 478 of the lip 454 or between the shoulder portion 470 and the inner surface 476 of the lip 454, depending on the rotational position of the threaded shaft 236. This gap 480 provides the secondary slop or looseness, enabling the threaded shaft 236 to rotate until the first protrusion 462 or the shoulder portion 470 makes physical contact with the lip 454, preventing further rotation. In addition the gap 480 provides the knob 240 with the freedom to rotate relative to the side surface 450*a*.

Because of the gap 480, it is possible for the threaded shaft 236 to rotate during the locked mode due to inadvertent or intentional forces by the user or environment. Although such lock mode rotation would not cause the lateral adjuster 112 to move relative to the vertical adjuster 108, such lock mode rotation can create confusion and complexity for the user. For example, such lock mode rotation can change the user's desired setting via the visual indicators 196. This can cause the user to lose track of the desired position of the knob 240.

In an embodiment, there is a method for manufacturing the bow accessory mounting system 12. The method prevents, inhibits, decreases or decreases the effects of this secondary slop. According to the method: (a) the knob 240 is separated from the threaded shaft 236; (b) the threaded shaft 236 is inserted into the channel 452; (c) a spacing tool 479 (FIG. 39C) is positioned adjacent to the side surface 450*a* (between the outer surface 478 of the lip 454 and the first protrusion 462 of the knob 240) prior to positioning the knob 240 on the engagement portion 472; (d) the knob 240 is pressed onto the engagement portion 472 so that the knob 240 is exterior and adjacent to the first side surface 450*a*, and the pressing force continues until the first protrusion 462 of the knob 240 reaches the spacing tool 479; and (e) the spacing tool 479 is removed. In an embodiment, the spacing tool includes a shim having a width or thickness of 0.001 inches or less and acts as a shim member.

Due to the spacing tool 479, the gap 480 is relatively small or otherwise minimized. For example, in an embodiment, when the lateral adjuster 112 is in the locked mode, the lateral driver 232 (including the knob 232) has a rotational freedom that is equal to or less than the rotation necessary to axially move one one-thousandths of an inch. Thus, undesired rotation of the lateral driver 232 (including the knob 232) is substantially prevented or limited in the locking mode.

In an embodiment, the vertical adjuster 108 and the vertical driver 184 have the same elements, components and functionality as the lateral adjuster 112 and the lateral driver 232 described above with respect to FIGS. 40-43. For example, the manufacturing method and spacing tool 479 described above are applicable to the manufacture and installation of the vertical driver 184 to reduce or minimize the undesired rotation of the vertical driver 184 (including the knob 192) during the locked mode of the vertical adjuster 108.

Referring to FIGS. 33-37, in an embodiment, the accessory 10 includes an arrow rest device 308 incorporated into the bow accessory mounting system 12, resulting in an arrow rest assembly 310. In this embodiment, the arrow rest assembly 310 includes an arrow launcher or arrow holder 284 and a capture bar 288. In an example, the capture bar 288 is coupled to the lateral adjuster 112 via a dovetail connection 292. For example, a male dovetail-shaped portion 294 (FIG. 38) of the capture bar 288 engages the female dovetail-shaped portion 298 (FIG. 36) of the lateral adjuster 112. The dovetail connection 292 provides increased security and adjustability to the capture bar 288.

Additional embodiments include any one of the embodiments described above and described in any and all exhibits and other materials submitted herewith, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An arrow rest assembly comprising:

a bow engagement portion configured to be mounted to an archery bow, wherein the archery bow comprises a bowstring moveable within a first plane, and the archery bow comprises a riser, wherein at least part of the riser extends along a riser axis that intersects with a second plane;

a coupler configured to couple the bow engagement portion to the archery bow;

an accessory support coupled to the bow engagement portion, wherein the accessory support is configured to support a bow accessory, the accessory support comprising:

a vertical adjuster configured to enable the accessory support to be moved relative to the bow engagement portion along a vertical axis, wherein the vertical axis intersects with the second plane, wherein the vertical adjuster comprises:

a vertical support;

a vertical driver rotatably engaged with the vertical support; and a vertical biaser supported by one of the vertical support and the vertical driver, wherein the vertical biaser is configured to cause a vertical force to act on the vertical driver along the vertical axis; and a lateral adjuster configured to enable the accessory support to be moved relative to the bow engagement portion along a lateral axis, wherein the lateral axis intersects with the first plane, wherein the lateral adjuster comprises:

a lateral support;

a lateral driver rotatably engaged with the lateral support; and a lateral biaser supported by one of the lateral support and the lateral driver, wherein the lateral biaser is configured to cause a lateral three to act on the lateral driver along the lateral axis; and an arrow rest accessory supported by the accessory support, wherein the arrow rest accessory comprises an arrow holder, wherein the arrow holder defines a space configured to receive a portion of an arrow.

2. The arrow rest assembly of claim 1, wherein each of the vertical and lateral supports comprise a plurality of support threads that are spaced apart from each other, wherein each of the vertical and lateral driver comprise a plurality of driver threads that are spaced apart from each other, wherein the support threads are configured to mate with the driver threads, and wherein each of the vertical and lateral biaser is configured to maintain a plurality of the driver threads in physical contact with a plurality of the support threads.

3. The arrow rest assembly of claim 2, wherein:

the driver threads comprise a plurality of driver crest surfaces, a plurality of driver root surfaces and a driver gap between each of the driver crest surfaces;

the support threads comprise a plurality of support crest surfaces, a plurality of support root surfaces and a support gap between each of the support crest surfaces;

when the driver threads are mated with the support threads, the driver gaps and the support gaps are associated with a thread looseness; and the vertical and lateral biasers are configured to eliminate the looseness.

4. The arrow rest assembly of claim 1, wherein the lateral adjuster further comprises:

a lateral adjustment portion coupled to the lateral driver, the lateral adjustment portion defining a series of lateral position setting cavities;

a lateral adjustment stopper configured to be at least partially inserted into any one of the lateral position setting cavities; and a lateral adjustment biasing member configured to urge the lateral adjustment stopper to be at least partially inserted into one of the lateral position setting cavities.

5. The arrow rest assembly of claim 1, wherein the vertical adjuster further comprises:

a vertical adjustment portion coupled to the vertical driver, the vertical adjustment portion defining a series of vertical positioning cavities;

a vertical adjustment stopper configured to be at least partially inserted into any one of the vertical positioning cavities; and a vertical adjustment biasing member configured to urge the vertical adjustment stopper to be at least partially inserted into one of the vertical positioning cavities.

6. An arrow rest assembly comprising:

a bow engagement portion configured to be mounted to an archery bow;

an accessory support configured to be coupled to the bow engagement portion, wherein the accessory support comprises an adjuster configured to enable the accessory support to be moved relative to the bow engagement portion along an adjustment axis, wherein the adjuster comprises:

an adjuster support defining a space, wherein the space comprises a cavity within the adjuster support;

a driver at least partially positioned within the space, the driver being rotatably engaged with the adjuster support; and a biaser configured to cause a force to act on the driver along the adjustment axis; and an arrow rest accessory supported by the accessory support, wherein the arrow rest accessory comprises an arrow holder.

7. The arrow rest assembly of claim 6, wherein the adjustment axis comprises one of: (a) a vertical axis that intersects with a first plane; and (b) a lateral axis that intersects with a second plane.

8. The arrow rest assembly of claim 6, wherein the driver is configured to rotate clockwise and counterclockwise at different times, and wherein, during each rotation of the driver, the force urges the driver against the adjuster support, and the rotation causes the accessory support to move along the adjustment axis.

9. The arrow rest assembly of claim 6, wherein the driver comprises a shaft having a threaded surface with a plurality of threads.

10. The arrow rest assembly of claim 6, wherein:

the arrow holder defines another space configured to receive a portion of an arrow and the biaser is configured to generate a biasing force; and the force is derived, at least in part, from the biasing force.

11. The arrow rest assembly of claim 10, wherein:

the biaser comprises a spring characteristic; and the adjuster support defines a plurality of threads configured to mate with the threads of the driver.

12. The arrow rest assembly of claim 11, wherein the biaser is configured to cause the force so that, during and after any operation of the adjuster, a plurality of the threads of the driver are in physical contact with a plurality of the threads of the adjuster support.

13. The arrow rest assembly of claim 6, wherein the biaser comprises a leaf spring.

14. The arrow rest assembly of claim 6, wherein the biaser comprises a nut body having a first portion, a second portion extending parallel to the first portion, a gap extending between the first portion and the second portion, and an aperture extending through the first portion, the gap, and the second portion, wherein at least the first portion is configured to flex relative to the second portion.

15. The arrow rest assembly of claim 6, wherein the adjuster further comprises:

an adjustment portion coupled to the driver, the adjustment portion defining a series of positioning cavities;

an adjustment stopper configured to be at least partially inserted into any one of the series of positioning cavities; and an adjustment biasing member configured to urge the adjustment stopper to be at least partially inserted into one of the series of positioning cavities.

16. The arrow rest assembly of claim 6, wherein:

the biaser is at least partially supported by one of the adjuster support and the driver; and the biaser comprises one of: (a) a configuration in which the biaser at least partially receives the driver; (b) a configuration in which the biaser encircles the driver; (c) a configuration in which the biaser physically contacts the driver; and (d) a configuration in which the biaser is directly connected to the driver.

17. An arrow rest assembly comprising:

a bow engagement portion configured to be coupled to an archery bow;

an accessory support assembly configured to be coupled to the bow engagement portion, wherein the accessory support assembly comprises an adjuster configured to enable the accessory support assembly to be moved relative to the bow engagement portion along an adjustment axis, wherein the adjuster comprises:

a driver comprising an end section;

a support comprising an inner surface defining a space, wherein the space is configured to at least partially receive the end section, the end section being moveably coupled to the support; and a biaser at least partially supported by one of the driver and the support, wherein the biaser is configured to cause a force to act on the driver along the adjustment axis; and an arrow rest accessory supported by the accessory support assembly, wherein the arrow rest accessory comprises an arrow holder.

18. The arrow rest assembly of claim 17, wherein the adjustment axis comprises one of a vertical axis and a lateral axis.

19. The arrow rest assembly of claim 17, wherein:

a threaded surface of the driver comprises a first threaded surface;

the driver comprises a shaft comprising a second threaded surface;

each of the first and second threaded surfaces comprises a plurality of threads; and the biaser comprises a leaf spring.

20. The arrow rest assembly of claim 17, wherein:

a threaded surface of the driver comprises a first threaded surface;

the support comprises a second threaded surface;

the biaser comprises a third threaded surface; and the second and third threaded surfaces are each engaged with the first threaded surface.

21. The arrow rest assembly of claim 17, wherein:

the biaser comprises a spring characteristic associated with a biasing force;

the biaser is configured to generate the biasing force; and the force is derived, at least in part, from the biasing force.

22. The arrow rest assembly of claim 17, wherein the biaser comprises one of: (a) a configuration in which the biaser at least partially receives the driver; (b) a configuration in which the biaser encircles the driver; (c) a configuration in which the biaser physically contacts the driver; and (d) a configuration in which the biaser is directly connected to the driver.

* * * * *